US006014824A

United States Patent [19]

Gumbert

[11] Patent Number: 6,014,824

[45] Date of Patent: Jan. 18, 2000

[54] SHOE LAST AND FOOTWEAR MANUFACTURED THEREWITH

[76] Inventor: Jerry F. Gumbert, P.O. Box 92, 3 Main St., Sigel, Pa. 15860

[21] Appl. No.: 09/218,465

[22] Filed: Dec. 22, 1998

Related U.S. Application Data

[62] Division of application No. 08/979,421, Nov. 24, 1997, which is a division of application No. 08/518,114, Aug. 28, 1995, Pat. No. 5,718,013, which is a continuation-in-part of application No. 08/327,212, Oct. 21, 1994, abandoned, which is a continuation of application No. 08/032,135, Mar. 17, 1993, abandoned, which is a continuation-in-part of application No. 07/861,460, Apr. 1, 1992, abandoned.

[51] Int. Cl.[7] ..... A43B 13/14; A43B 13/00

[52] U.S. Cl. ..... 36/103; 36/25 R; 36/30 R

[58] Field of Search ..... 12/133, 146 L, 12/114 Z, 53.6, 124, 125, 128, 133 B, 133 A; 36/103, 25 R, 28, 30 R, 102

[56] References Cited

U.S. PATENT DOCUMENTS

| | | |
|---|---|---|
| 881,338 | 3/1908 | Post . |
| 1,027,016 | 5/1912 | Volnagel . |
| 1,094,739 | 4/1914 | Mountain . |
| 1,137,141 | 4/1915 | Holmes . |
| 1,283,128 | 10/1918 | Fernald . |
| 1,556,802 | 10/1925 | Page . |
| 1,948,547 | 2/1934 | Topham . |
| 1,971,108 | 8/1934 | Karow . |
| 2,002,580 | 5/1935 | MacDonald . |
| 2,119,590 | 6/1938 | MacDonald . |
| 2,167,796 | 8/1939 | Biddle . |
| 2,309,775 | 2/1943 | Levitt . |
| 2,593,742 | 4/1952 | Friedman . |
| 2,610,340 | 9/1952 | Nettler et al. . |
| 2,699,562 | 1/1955 | Murray . |
| 2,716,294 | 8/1955 | Schwartz et al. . |
| 2,877,502 | 3/1959 | Murray . |
| 2,907,067 | 10/1959 | Burger . |
| 3,262,142 | 7/1966 | Keder . |
| 3,696,456 | 10/1972 | Dunham et al. . |
| 4,348,821 | 9/1982 | Daswick . |
| 4,542,598 | 9/1985 | Misevich et al. . |
| 4,559,723 | 12/1985 | Hamy et al. . |
| 4,619,058 | 10/1986 | Gumbert . |
| 4,662,079 | 5/1987 | Graf et al. . |
| 4,785,557 | 11/1988 | Kelley . |
| 4,942,678 | 7/1990 | Gumbert . |
| 4,956,927 | 9/1990 | Misevich et al. . |
| 4,969,224 | 11/1990 | Birke . |
| 4,989,349 | 2/1991 | Ellis . |
| 5,012,596 | 5/1991 | Schiller . |
| 5,231,723 | 8/1993 | White et al. . |
| 5,661,864 | 9/1997 | Valiant et al. . |
| 5,718,013 | 2/1998 | Gumbert . |

FOREIGN PATENT DOCUMENTS

| | | |
|---|---|---|
| 1176458 | 10/1984 | Canada . |
| 0323099 | 4/1989 | European Pat. Off. . |
| 9117677 | 1/1991 | WIPO . |

*Primary Examiner*—Ted Kavanaugh
*Attorney, Agent, or Firm*—Wood, Herron & Evans, LLP

[57] ABSTRACT

A footwear last usable in the mass production of footwear comprises a solid body having a top, bottom, toe and heel portion with a smooth contoured sole surface connecting the toe and heel portion including an inner longitudinal arch formed on the sole surface and on an inner side of the last, an outer longitudinal arch formed on the sole surface on an outer side of the last. A first transverse arch formed proximate the toe portion. A second transverse arch formed forward of the heel portion. The smooth upper surface transitions to the smooth sole surface in a continuous curve free from a sharply angled last bottom featherline and the contoured sole surface defines three separate and distinct contact areas. The sole surface projects cross-sections of varying percentages with respect to the total cross-sectional area onto a base plane at different heights above the base plane in accordance with the unique contours of the sole surface. Invention footwear made on the last of the invention reflects unique projected cross-sections of the last onto a base or grand plane when the footwear is worn.

18 Claims, 8 Drawing Sheets

SHOE LAST AND FOOTWEAR MANUFACTURED THEREWITH

CROSS REFERENCE TO RELATED APPLICATIONS

"This application is a divisional of pending application Ser. No. 08/979,421, entitled SHOE LAST AND FOOTWARE MANUFACTURED THEREWITH, filed Nov. 24, 1997, still pending which is a divisional of application Ser. No. 08/518,114, entitled SHOE LAST AND FOOTWARE MANUFACTURED THEREWITH, filed on Aug. 28, 1995 (now issued as U.S. Pat. No. 5,718,013), which is a continuation-in-part of application Ser. No. 08/327,212 entitled SHOE LAST, filed Oct. 21, 1994, now abandoned, which is a continuation application of application Ser. No. 08/032,135, entitled SHOE LAST, filed Mar. 17, 1993, now abandoned, which is a continuation-in-part application of application Ser. No. 07/861,460, entitled SHOE LAST, filed Apr. 1, 1992, now abandoned, which applications and issued patent are completely incorporated herein by reference in their entireties."

FIELD OF THE INVENTION

The present invention relates to a shoe-making last for mass production and manufacturing of footwear. More specifically, this invention relates to a last which incorporates appropriate aspects of both static and dynamic human physiology to produce footwear that is better fitting and more comfortable to the human foot both at rest and in motion than is possible utilizing conventional last technology. The invention further relates to footwear manufactured on such a last.

BACKGROUND OF THE INVENTION

A shoe-making last is the most important component in the production of footwear. A last is the solid, three-dimensional mold over which footwear is made and the last dictates the size, shape and fit of the footwear made thereon. When manufacturing shoes, and other footwear, the last is firmly mounted, and the pieces of shoe material, whether upper or sole material, are placed around the last and attached together to make the footwear.

The interior space of any item of footwear is an exact reflection of the exterior shape of the last regardless of the outer cosmetic features or styling of the footwear. All footwear built on the same last has the same interior space and dimensions and generally yields the same fit for a particular wearer. Consequently, the shape and configuration of the last is critical in order to make footwear which fits comfortably on the foot, provides adequate support and performs essentially as an extension of the human foot, as is desired.

Footwear manufacturing is a precise and sometimes tedious process. Particularly, the last must be precisely shaped, sized and graded to produce useable footwear. Conventional lasts are not casts of the feet, and indeed, a cast of the foot is not suitable to use as a last. Rather, a conventional last is a precise and highly refined piece of equipment used in footwear production and is precisely measured and referenced according to the dictates of conventional last technology. The last of the present invention is also a precise and refined piece of equipment but is drastically different from conventional lasts, and a brief analysis of the various precise measurements and dimensions associated with conventional lasts is helpful in illustrating the differences between last of the invention and conventional footwear lasts.

FIGS. 5, 5A, 5B and 6 illustrate conventional footwear lasts, and particularly, the figures show a conventional last 5 for a woman's high-heel shoe. While a man's shoe last would generally have a lower heel, the overall shape and dimensions of the last illustrated and discussed herein are generally common to all conventional lasts. FIGS. 5, 5A and 5B and 6 clearly illustrate a critical and common feature of all conventional lasts, i.e. a flat bottom surface 10 and a distinct and sharply-angled last bottom featherline 12, defined by the sharp angle created when the upper surface 14 of the last meets the flat sole surface 10. Base plane 18 is a plane to which the last is referenced in its proper or upright attitude for the purpose of defining the precise last terms and dimensions. The conventional last has a front cone 20 and a back cone 22. While the sole surface 10 is generally flat, there may be a very slight transverse and downward curvature illustrated in FIG. 5B and defined as the crown 24. At the rear of the last, point 25 is defined as the heel point and is the rearmost point of the heel seat 29 on the featherline 12. Reference line 26 defines the back cone height. Point 28 is the breast line point which defines the forward boundary of the heel seat 29. The heel seat 29 is defined as the bottom surface of the heel end of the last 5. The heel elevation of the last is indicated by numeral 30 while the wedge angle 32 of the heel seat 29 defines the angle between the base plane 18 and the heel seat 29. Referring to FIG. 5A, the back part width 36 is the width of the heel seat 29 measured parallel to the heel seat featherline plane at a specified distance forward of the heel point 25 and above the heel seat 29, while the heel seat width 38 is the greatest width of the heel seat 29 measured from the sharp featherline on one side of the heel seat 29 to the other featherline generally perpendicular to a defined heel center line 37.

Referring to FIG. 6, the stick length 40 designates the overall length of the last 5. In the front cone 20 of last 5, a vamp point 42 is defined on the top of the forepart 44 of the last 5. In the back part 46 of the last and forward of the heel seat 29 is the shank 47. At the point of intersection of the shank 47 and the forepart 44 of the last, a last joint breakpoint 48 is defined. The last joint breakpoint 48 lies in a plane which passes through the heel point 25 and is perpendicular to the plane of the last centerline 37. The circumferential measurement across forepart 44 of the last 5, between the vamp point 42 and the last joint breakpoint 48, is designated as the joint girth 50. Another circumferential measurement, the instep girth 51, is measured around the last front cone 20 and passes through a defined instep point 52. The waist girth 54 is the circumferential dimension around the last 5 between the joint girth 50 and the instep girth 51.

The throat opening 56 of the last is defined as the distance in a straight line from the vamp point 42 to a back seam tack point 58 which is defined on the last above the heel seat 29. While the long heel girth 60 is defined as the dimension between the heel point 25 and the instep point 52.

The forepart 44 of conventional lasts also are similarly shaped and are defined by precise dimensions referenced from the base plane 18 and particularly from the sharply-angled featherline 12 at the toe region of the last. As illustrated in FIG. 5B, the sharply-angled featherline 12 in the forepart 44 is defined by the flat sole surface 10 of last 5 meeting a wall portion 62 around the periphery of the last forepart 44. The wall portion 62 is characterized by relatively vertical sides. The perimeter defining the intersection between the vertical walls 62 and the upper surface of the forepart 44 of the last 5 is designated as the ridge 64 of the last. A toe point 66 is defined as the forwardmost point of the toe end 67 of the last along the featherline 12. Conventional lasts sharply recede from a point of full toe thickness to the toe point 66. In the toe end 67, the sharp slope or recession of the upper surface of the last down to the angled featherline 12 at the toe point 66 is termed the toe recede. Conventional lasts also utilize an elevated toe and as illustrated in FIG. 5, the flat sole surface 10 in the toe end 67 angles upwardly from the base plane to the toe point 66. The vertical distance between the base plane 18 and the toe point 66 of the last is defined as the toe spring 69. The toe spring 69 is measured for a last having a particular heel elevation 30.

Because of the generally planar sole surface 10, each last 5 has a single tread point or tread area 68 where contact is made with the base plane 18 when the last 5 is in its upright or primary position. Referring again to FIG. 5, if the last 5 was allowed to rest on the base plane, there would generally only be two points or surface areas of contact between the last 5 and the base plane—the tread point or area 60 defined as the desired contact point or area forward of the last joint breakpoint 48, and a point or area proximate the heel seat 29.

The above-discussed dimensions and defined reference points are not all of the precise last dimensions or points of measurement which are utilized in the manufacturing of shoes with conventional lasts. From the measurement points and dimensions discussed hereinabove, it becomes evident that conventional last technology and the traditional manufacturing of footwear is more than simple molds and assembling various material pieces together to form footwear which fits comfortably around the human foot. As is illustrated, the fundamental definition of a conventional last and the defined reference points and dimensions are all heavily reliant upon a flat sole surface and the sharply-angled featherline surrounding the last. Indeed, all current shoe manufacturing utilizes conventional lasts and last technology with the only difference between different shoes being variations in some of the length, height and girth dimensions and measurements defined by conventional last technology. Conventional lasts and last technology generally does not provide footwear which works in harmony with the human foot.

By way of background, conventional footwear manufacturing is essentially the process of joining two basic parts, the upper and the bottom, together around the last. The conventional footwear upper includes a vamp which covers the toe region and forepart of the last, and the quarters, which cover the sides and back part of the last. The bottom of conventional footwear consists primarily of an insole, a sole and a heel. The top of the footwear which surrounds the opening for the foot is called the top line 87. The lower extremity where the upper meets the sole is called the feather edge. Referring to FIG. 6A, numeral 71 designates the angled feather edge of a conventional women's shoe 73. In a shoe 73 made on a conventional last as shown in FIGS. 5, 5A, 5B and 6, the sharply angled feather edge 71 clearly delineates the footwear upper 75 from the flattened footwear sole 77. FIG. 6B illustrates a conventional man's shoe 79 built on a traditional last similar to the last in FIGS. 5, 5A, 5B and 6 except with a different heel elevation, toe shape and joint girth among some other differences. The man's shoe 79 also illustrates a respective sharply-angled feather edge 81 created by the angled featherline 12 of the last 5. When upper patterns are cut for conventional footwear, an additional margin of material is added to the feather edge which allows the upper to be wrapped around the sharp featherline and attached to the rest of the footwear. The additional material that is necessary is termed the "lasting allowance," because it is dictated by the shape of a conventional last. Furthermore, conventional shoes often must include a mass of material 83 termed the arch support for artificially supporting the foot due to the positioning of the foot on a rigid sole 85.

The term "making" refers to the process of bringing together the components of the upper and bottom and joining them to "make" footwear. There are numerous ways in which footwear can be made and each method of construction shares essentially a sequence of three steps which result in the components being brought together around a conventional last and assembled into footwear. The three basic steps to footwear construction are: (1) assembly; (2) lasting; and (3) attaching.

Assembly refers to the bringing together of all the components of the shoe including stitched and closed uppers and the insoles, soles and heels of the bottom. Some footwear may have additional components depending upon the method of construction, type of footwear and the intended application. However, the components which are assembled together are, in some form or another, common to all footwear which are intended for normal wear as distinguished from slippers or water protectant overshoes and some other specialty footwear items.

When all the necessary components have been assembled, components are matched with each other and then married to a last which matches the style, size and width of the assembled components. All the matched and married components and their corresponding lasts are identified in groups prior to proceeding in the manufacturing process.

Following completion of the assembly, lasting takes place. Lasting refers to a process of stretching the upper material over the conventional manufacturing last and pulling the lasting allowance around the last bottom featherline. The lasting allowance is then secured to the flat sole surface 10 of the last either with tacks or with adhesive. The flat insole must then match the flat sole surface of the last. When lasted correctly, the upper material conforms itself to the contours of the last and retains the contours even when the last is ultimately removed. Upon completion of lasting, the featherline of the last, translated into the sharply-angled feather edge around the insole, clearly defines the upper from the bottom of the footwear just as the last bottom featherline clearly defines the upper surface of the last from the flattened sole surface of the last.

Upon completion of the lasting steps, the footwear is ready for attachment of the sole. "Attaching" refers to the process of affixing a flat sole to the lasted upper material using adhesives, nails, pegs or some combination of them. There are various types of attachment methods including direct attachment where the sole is attached to the bottom of the insole to which the upper has been attached, and indirect attachment wherein a layer or layers of material are placed between the insole and the outer sole and the outer sole is attached thereto. The styles and materials of the shoe, along with the construction and available equipment dictate the attaching process utilized.

Regardless of the method of construction and attachment of the material components used to make conventional footwear, the methods of footwear manufacturing utilize and require a conventional last which has a shape fundamentally different than that of the human foot for which the footwear product is designed. The machinery and equipment used for lasting of the upper and attachment of the outer sole to the lasted upper along with the finishing operations requires that the last have a last bottom featherline and a flat sole surface for proper sole attachment.

All existing shoe lasts, whether for mass manufacturing or custom footwear exhibit a flat sole surface which meets the upper last surface at approximately a 90° angle defined by the last bottom featherline. The last bottom featherline dictates a sharply-angled feather edge in the finished footwear. Industry reference publications, such as *Manual of Shoe Making*, C. & J. Clark, Ltd. Copyright 1976; *American Last Making*, Carl Adrian, Copyright 1991; *Professional Shoe Fitting*, National Shoe Retailers Association, Copyright 1984; and *Last Terms and Terminology*, American Footwear Industry, Copyright 1976, all emphasize the importance and need for a last having a sharply-angled bottom featherline to make it possible to accurately attach the outer soles and subsequently finish the footwear. Furthermore, the patents of MacDonald U.S. Pat. No. 2,002,580 and Keder U.S. Pat. No. 3,262,142 illustrate in the figures and discuss in the text the difference between a foot cast and a resulting last for manufacturing footwear.

In short, conventional footwear lasts are not molds of the human foot. While a cast of a foot might be utilized for measurement purposes to make a custom pair of shoes, a foot cast cannot function as a last. A last, by conventional teaching, must have a flat sole surface, an elevated heel and sharp angling between the upper surface of the last and the sole surface to create a sharply-angled bottom featherline. Furthermore, the heel surface must be squared to a base plane and the last shaped such that a line drawn vertically down the middle of the back of the last is generally perpendicular to the ground or base plane. Despite conventional last technology and the footwear manufactured therewith, such conventional lasts have fallen short of the goal of providing footwear which works in harmony with the human foot. Such disharmony is created by the differences between a human foot and a conventional last.

For example, conventional lasts have sharply defined featherlines at the point of transition from the flat sole surface or crown to the vertical sidewalls of the last between the defined featherline and the last ridge. The human foot is not sharply angled. The last ridge and sharply-angled contours of a conventional last only take into account generally the static shape of the foot whereas during the wearing of footwear, the foot will undergo dynamic shape changes as well. Conventional lasts utilize heel curves which are overly exaggerated to promote a gripping of the foot by the footwear. The heel seat of a conventional last is angled to correspond with introduction of an elevated heel onto the sole surface. The heel of a human foot is not elevated and has no such heel pitch. In the toe region of a conventional last, the toe profile decreases or recedes to the sharply defined featherline in the forepart of the last while human toes generally maintain a uniform thickness throughout their length. Furthermore, an upward toe spring of the last forepart is utilized while the human foot has no such toe spring.

As discussed above, the heel seats of conventional lasts are generally unnaturally raised to different heel elevations to accommodate the heel for the footwear being manufactured. The only accommodation for the natural and dynamic shape of the human foot in the conventional last might be the fitting of the width of the last and the modest sloping to accommodate a sloped, flat shank between the elevated heel seat and the forepart of the last. While the slope between the forepart and heel seat provides a slight transition in the conventional last, the shank area still has a sharply-angled featherline and the sole surface at the shank is generally planar in a transverse direction to match with the flat sole surface and sharply-angled featherline existing in other areas on the rest of the last.

Still further, the conventional last is engineered to distribute the pressure of standing, walking, running or jumping across 100% of the bottom surface of the last, i.e., across 100% of the rigid and flat sole surface. However, the average human foot is engineered to distribute such pressures across approximately 75–80% of the bottom surface of the foot. Therefore, conventional last technology dictates that the footwear manufactured thereon will unnaturally affect the weight bearing and propulsion characteristics of the foot.

Another characteristic of a conventional last which deviates from a natural foot shape is the orientation of the flat sole surface perpendicular to a last centerline plane which is defined by the last centerline 37 as shown in FIG. 6. The heel seats of all conventional lasts are squared to be perpendicular to the centerline plane. However, the intersection of a plane defined by the back of the human lower leg and a horizontal ground or base plane on which the human foot rests is not perpendicular. Thus footwear manufactured from conventional lasts contains and binds the foot in the heel region and in an unnatural position.

As a result of the shape and dimensions of conventional lasts, the lasts and the footwear manufactured thereon have fallen short of the goal of providing footwear which works in harmony with the human foot and thus do not provide comfort to the wearer during standing, walking or running. One major drawback with conventional last is the flat bottom sole surface which dictates that a flat, rigid piece of sole material be attached to footwear upper material at the sharply-angled last featherline, thus producing footwear which has an approximately 90° angled feather edge. The foot is thereby supported artificially on a stiff, flat platform. The human foot at rest and particularly in motion has a tendency to want to fall off the end of the stiff sole platform of the shoe, thus increasing the risk of ankle injuries. The drawbacks of the sharply-angled feather edge of a shoe made from a conventional last are exacerbated by the elevation of the heel seat, the recession of the toe, the unnatural forward pitch of the heel seat and the unnatural upper spring of the toe region of the last.

To offset some of the effects of the stiff platform on the human foot, shoe manufacturers must artificially reinforce the underside of the wearer's foot by placing a mass of material on the inside of the shoe to coincide with and bolster the foot's natural arches. For example, FIG. 6B illustrates the arch support 83 underneath the foot but above the feather edge 81 of men's footwear 79 from a conventional last. However, as can be appreciated, the natural human foot neither has nor requires what is commonly referred to as "arch support." The unnatural stiff support 83 and arch reinforcement in shoes made using conventional lasts therefore further results in a disharmony between the foot and the shoe which can produce, among other things, foot discomfort, back pain and an increased risk of injury.

The motivation behind the shape and dimensions of a conventional last is to achieve more efficient and economical manufacturing of footwear because, essentially, a last is a piece of mechanical equipment for making footwear. However, it is well known by knowledgeable medical and footwear person that conventional lasts yield footwear that eventually damages the feet of some if not most of the wearers, and also diminishes the physical capabilities of the wearers by interfering with the human body's natural operations. While more comfortable and biomechanically correct footwear is desired, to date, it has not been possible to efficiently and economically produce footwear without utilizing conventional lasts and last technology and thus creating footwear having the drawbacks associated therewith and discussed hereinabove.

The shortcomings of footwear manufactured on conventional lasts is evidenced by the fact that approximately 73% of persons in the United States experience some form of problems with their feet. Such problems take many forms including corns, callouses, bunions, blisters, ingrown nails, hammer toes and other deformities and maladies of the foot. However, only 3% of persons in non-shoe wearing countries experience any sort of foot problems, and those persons skilled in the art in both footwear and medicine agree that footwear designed with conventional lasts is the culprit of such statistical variations.

Accordingly, there is a very definite need for a footwear manufacturing last which addresses the shortcomings of conventional lasts and provides footwear which will reduce if not eliminate many of the foot problems associated with footwear manufactured on conventional lasts.

It is further an objective of the invention to provide a piece of equipment for mass-manufacturing footwear which is more in harmony with the human foot, both at rest and in motion.

It is still further an objective of the present invention to create footwear which is biomechanically more in harmony with the shape of the human foot to reduce and eliminate the shortcomings of footwear produced with a conventional last.

It is another objective to present a last which may be readily sized and graded to produce footwear for a large variety of wearers.

It is still another objective of the present invention to provide footwear manufactured with the last of the present invention which incorporates the unique design of the invention last and provides comfort, stability, and proper weight distribution to a wearer.

SUMMARY OF THE INVENTION

The above-discussed objectives and other objectives are addressed by the unique footwear last of the present invention and the footwear manufactured using the inventive last.

The footwear last is primarily utilized in the mass production of footwear capable of being worn by numerous different wearers. Although, the last might also be utilized to manufacture custom footwear.

The last is comprised of a solid body having a top, a bottom, a toe portion and a heel portion. A smooth upper surface connects the toe portion and the heel portion on the top of the last body and the smooth upper surface is configured to receive an upper material layer for building footwear. A smooth sole surface connects the toe portion and the heel portion on the bottom of the last body and is configured to receive a sole material layer. The last body sole surface is not flattened as is conventional but comprises a series of unique arches which address the variations in shape of the foot experienced during dynamic propulsion versus static weight bearing. More specifically, a unique inner longitudinal arch is formed in the sole surface and extends from the heel portion to the toe portion on an inner side of the last. An outer longitudinal arch is formed on the sole surface to extend from the heel portion to the toe portion on an outer side of the last opposite the inner longitudinal arch. A forward transverse arch is formed on the sole surface proximate the toe portion of the last and a rearward transverse arch is formed forward of the heel portion and also on the sole surface. The transverse arches intersect both of the longitudinal arches in the forepart and rear parts of the last. The arches of the inventive last, in accordance with the principles of the present invention, produce footwear which reduces binding and friction of the foot and is generally in greater biomechanical harmony with the foot than is footwear produced on conventional lasts.

The smooth upper surface of the last body transitions to the smooth sole surface in a continuous curve which is free from any sharp angles. Therefore, the last of the present invention does not have the sharply-angled last bottom featherline which is used and, indeed, must be used, with all conventional lasts.

The sole surface is contoured with the four arches cooperating to formed arched surfaces and to define a group of three discrete contact points on the sole surface of the last which intersect a defined horizontal base plane when the last is in a primary or upright position on the base plane. A first contact point is located proximate a forward end of the inner longitudinal arch and lies generally in the toe region of the last. The first contact point is generally proximate an intersection point between the inner longitudinal arch and the forward transverse arch. The second contact point is located proximate a forward end of the outer longitudinal arch and also is located in the toe portion opposite the first contact point and slightly rearward thereof. The second contact point is generally proximate an intersection point between the outer longitudinal arch and the forward transverse arch. The third contact point is located in the heel portion of the body and is proximate the rearward end of both the inner longitudinal arch and the outer longitudinal arch. When the last body is placed on a horizontal base plane surface, the last is supported at the three contact points and a majority of the contoured and arched sole surface is elevated above the horizontal base plane. In actuality, the defined contact points are not true infinitely small points but are small contact areas or surfaces.

The contact points are oriented on the sole surface of the last such that a line extending from the first contact point to the second contact point and a line extending from the first contact point to the third contact point form an angle of preferably approximately 54° and in the range of approximately 20° up to 120°. Lines extending from the second contact point to the first contact point, and from the second contact point to the third contact point, forms an angle of preferably approximately 100° and in the range of approximately 160° down to 50°. Lines extending from the third contact point to the first contact point, and from the third contact point to the second contact point form an angle of preferably approximately 26° and in the range of approximately 1° up to 45°. The three defined contact points in the sole surface of the last, in combination with their unique orientation and cooperation with the longitudinal and transverse arches of the sole surface, create a last which produces footwear that naturally positions the pressures of the foot, created by propulsion and weight bearing, to the areas of the sole surface which would be affected naturally by the human foot without footwear. The last invention thus eliminates the unnatural binding and shifting of pressures created by conventional lasts and the footwear produced thereon.

The last further comprises a parting line which extends around the last body above the horizontal base plane. The parting line is made up of the horizontally outermost side points of the last body when the last is in the primary position on the horizontal base plane. Any plane tangential to a point on the parting line is generally perpendicular to the horizontal base plane. Horizontal planes, located at incremental heights above the horizontal base plane, and parallel to the base plane project a horizontal cross-sectional area of the sole surface downwardly onto the base plane. Progressing upwardly into the last body from the base plane, the horizontal cross-sectional areas projected downwardly from the last progressively increase. For example, horizontal cuts through the uniquely contoured sole surface of the last will expose ever-increasing horizontal cross-sectional areas up to a certain height above the horizontal base plane. The projected cumulative cross-sectional area gradually increases according to the unique contour shape of the sole surface of the inventive last.

In conventional lasts with flat sole surfaces, a horizontal plane cross-section will generally provide a maximum cross-sectional area at a short distance above a base plane and the maximum cross-sectional area will be exposed in a single plane. However, in accordance with the principles of the present invention, the contoured sole surface of the inventive last, including the longitudinal and transverse arches and the three defined contact points, does not provide a maximum cross-sectional area in a single plane, but instead exposes cumulatively greater areas until the parting line is exceeded in all areas around the last. The parting line defines the boundary of the maximum cumulative horizontal cross-sectional area of the last body which may be projected downwardly onto the horizontal base plane and the parting line is not defined by a horizontal plane. The points of the parting line are at different and varying heights above the base plane.

The inner longitudinal arch has a maximum vertical height above the base plane defined by a point on the parting line. The sole surface of the last projects different cumulative horizontal cross-sectional areas downwardly onto the horizontal base planes depending upon the elevation above the horizontal base plane as a percentage of the maximum vertical height of the inner longitudinal arch.

At the base plane, the cumulative horizontal cross-sectional area projected downwardly by the three discrete contact points or areas is less than 5% of the maximum projected area defined by the parting line boundary.

Generally, the cumulative cross-sectional area projected by the three contact points is in the range of approximately 1% to 10% at the maximum. At a height above the base plane of approximately 2.5% of the maximum inner longitudinal arch height, the cumulative horizontal cross-sectional area projected onto the base plane is preferably approximately 13.5% of the maximum area and is in the range of approximately 10–20% of the maximum projected cross-sectional area defined by the parting line.

At a height above the base plane of approximately 5.0% of the maximum arch height, the cumulative horizontal cross-sectional area projected onto the base plane is preferably approximately 27% of the maximum area and is in the range of approximately 20–35% of the maximum projected area.

At a height above the base plane of approximately 7.5% of the maximum arch height, the cumulative horizontal cross-sectional area projected to the base plane is preferably approximately 44% of the maximum area and is in the range of approximately 35–50% of the maximum projected area.

Moving further up on the sole surface above the base plane, at a height of approximately 10% of the maximum arch height, the projected cumulative horizontal cross-sectional area is preferably approximately 57% of the maximum area and is in the range of approximately 50–60% of the maximum area.

At approximately 20% of the maximum arch height, the projected cumulative horizontal cross-sectional area is preferably approximately 78% of the maximum area and in the range of approximately 70–85% of the maximum projected area.

At a height above the base plane of approximately 30% of the maximum arch height, the cumulative horizontal cross-sectional area projected onto the base plane is preferably approximately 86% of the maximum area and is in the range of approximately 85–90% of the maximum area.

At a sole surface height above the base plane of approximately 40% of a maximum arch height, the cumulative horizontal cross-sectional area projected downwardly onto the base plane is preferably approximately 92% and is in the range of 90–93%. The remaining 60% of the arch height reveals the final approximately 7% of the remaining area to reach the maximum cumulative horizontal cross-sectional area.

The unique contouring of the sole surface of the inventive last with the unique variation of projected cross-sectional areas at various heights above the base plane has empirically been determined to produce footwear which distributes the weight and pressure of walking and running more naturally over the surface of the footwear sole than the footwear manufactured with conventional lasts which have a generally flat sole surface and a sharply angled feather edge around the flat sole surface.

The heel portion of the last body is shaped and configured to provide footwear with greater stability and comfort for the wearer. Particularly, a rearwardmost point in the heel portion bottom of the last body on the parting line is angled slightly from the rearwardmost point at the top of the last body. A line extending between the first and second rearwardmost points, which is referred to as the backseam line, forms an angle with the horizontal base plane of approximately 80–88° or with the centerline perpendicular to the base plane of approximately 2–10°. Preferably the angle will be around 6–7° with the centerline 144. Thus, the heel portion is not squared to be perpendicular to a base plane like a conventional last. The heel portion of the last is therefore designed to reflect the empirically determined shape of an average human foot, such that the footwear constructed on the last does not bind or otherwise constrict the foot unnaturally.

The last of the present invention produces footwear which is biomechanically in harmony with the human foot. There is no artificially created rigidly-angled feather edge nor a sole with a rigid, flattened bottom. Furthermore, the last of the invention eliminates the necessity of building up material underneath a wearer's foot-in either the heel or arch areas as done in conventional footwear-because the last of the invention produces footwear which allows the foot to assume its proper position at all times and naturally support itself.

Footwear manufactured with the last of the present invention reflects the inventive shape of the last. The footwear has inner and outer longitudinal arches on the sole surface which extend from the heel portion to the toe portion. The footwear thus produced also encompasses the first and second transverse arches formed in the sole surface of the last. Preferably, the upper material and insole lining of footwear manufactured on the last is slip-lasted or California slip-lasted onto the last. A cement method of construction is then utilized to attach the outer soles to the insoles. The entire item of footwear is then machine-stitched to completion. In accordance with the principles of the present invention, the inside, foot-receiving shape of the footwear reflects the unique shape and configuration of the inventive last. The footwear sole, in addition to having the four unique arches, also has three discrete contact points which intersect a defined horizontal ground plane when the footwear contacts the ground during use. Preferably, the thickness of the insole and the thickness of the outer sole are of uniform thickness across substantially the entire sole surface of the footwear, and therefore, the footwear reflects the unique contouring of the last sole surface, including the varying cumulative horizontal cross-sectional areas projected downwardly onto a horizontal base plane at various heights from the base plane as described hereinabove with respect to the last.

The inventive footwear of the invention reflects the unique configuration of the last and it has been empirically determined that the footwear will properly distribute the pressure from propulsion and weight bearing in the same manner that the bare foot of each unique wearer would distribute such pressure. Therefore, the unnatural distortion and binding of the foot caused by traditional footwear does not occur with footwear constructed in accordance with the principles of the invention. The footwear has no sharply angled feather edge and lacks the vertical walls and sharp ridges which exist around footwear manufactured with conventional lasts. The footwear operates in harmony with the human foot and will reduce many of the drawbacks associated with binding, stiff and constricting traditional footwear built on conventional lasts. The last of the invention may be sized and graded to produce footwear for a large number of wearers.

These and other advantages will become more readily apparent from a detailed description of the invention below.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

The file of this patent contains at least one drawing executed in color. Copies of this patent with color drawings will be provided by the Patent & Trademark Office upon request and payment of the necessary fee.

FIG. 5A is a cross-sectional taken along lines 5A—5A of FIG. 5, while

FIG. 6A is a side view of conventional women's shoe built on the last illustrated in FIGS. 5 and 6, while

DETAILED DESCRIPTION OF SPECIFIC EMBODIMENTS

The present invention encompasses a new footwear last and also footwear manufactured on the last.

Figure 1:
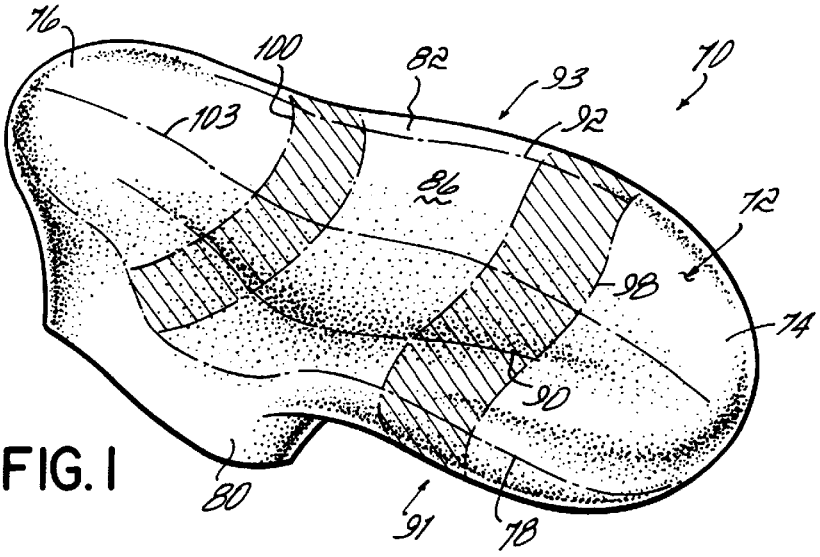
FIG. 1 is a bottom perspective view of the last of the present invention illustrating the unique arches of the sole surface.
Figure 4:
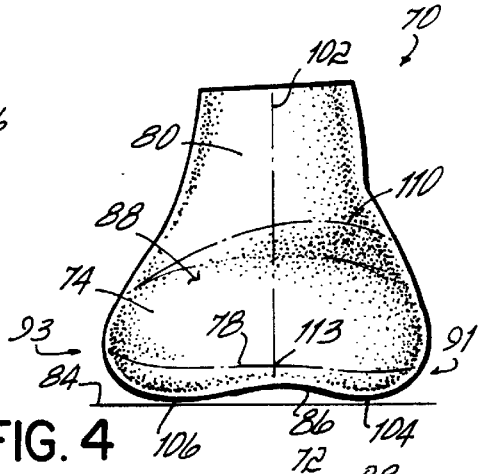
FIG. 4 is a front elevational view of the last of the present invention illustrating the forward transverse arch.

FIG. 1 is a bottom perspective view of the footwear-making last 70 of the present invention. Last 70 comprises a rigid body 72 having a toe portion 74 and a heel portion 76. The last body 72 is separated by a parting line 78 which defines the top 80 and bottom 82 of the last body 72. Parting line 78 is defined as a line which connects all of the outermost points of the last body 72 around the last body when the last 70 is in a primary position or upright position on a horizontal base plane or surface 84 as illustrated in FIGS. 3 and 4.

In the bottom 82 of the last, the toe portion 74 and heel portion 76 are connected by a smooth sole surface 86 which is contoured and shaped in accordance with the principles of the present invention to produce a last which is different from conventional lasts both in shape and operation. In the top 80 of the last, a smooth and shaped upper surface 88 also connects the toe portion 74 with the heel portion 76. According to the teachings of the invention, the rigid last body can be formed of an appropriate solid material such as wood or a plastic. The last body 72 is utilized with known footwear-making equipment and will produce footwear which is biomechanically in harmony with the human foot. Last 70 of the invention is primarily for the mass-production of footwear for a variety of different wearers; however, custom footwear might also be made on last 70 by someone skilled in the art.

The sole surface 86 of the last body 72 comprises a series of four cooperating arches which operate to properly position and distribute, in footwear manufactured with the last 70, weight and pressure associated with propulsion and weight bearing of the human body. Sole surface 86 includes an inner longitudinal arch 90 which extends generally the length of the last 70 and connects the heel portion 76 with the toe portion 74 along the inner side 91 of the last body 72. Sole surface 86 further comprises an outer longitudinal arch 92 on the outside 93 of the last body 72. The outer longitudinal arch 92 connects the toe portion 74 and heel portion 76 on the outer side 93 of the last body 72. While the inner longitudinal arch 90 and outer longitudinal arch 92 are indicated by reference lines, the arches 90, 92 intersect transverse arches formed on the sole surface 86 and actually will have finite widths to define arch areas such that the sole surface 86 is formed in accordance with the principles of the invention as further discussed in detail below. That is, the longitudinal arches 90, 92 are connected across the sole surface by transverse arches. Inner longitudinal arch 90 achieves its greatest height above the horizontal base plane 84 at the parting line area 78 in the region of the arch 90 as indicated by reference point 96.

The inner 91 and outer 93 sides of the last body 72 are connected across the sole surface 86 by a forward transverse arch 98 which extends across the last body 72 proximate the toe portion 74 of the body and slightly rearwardly of a majority of the toe portion. The forward transverse arch 98 makes a smooth transition between the inner longitudinal arch 90 and the outer longitudinal arch 92 and generally intersects the longitudinal arches 90, 92 in the toe portion 74 of the last 5.

The last body 72 further comprises a rearward transverse arch 100 which extends across the sole surface 86 proximate the heel portion 76 and generally forward of a majority of the heel portion. The rearward transverse arch 100 intersects the longitudinal arches 90, 92 and provides a smooth transition and connection between the rearward sections of the inner and outer longitudinal arches 90, 92. Similar to the longitudinal arches, the transverse arches have a finite width as illustrated in FIGS. 1 and 3 and essentially form arch areas. The two longitudinal arches 90, 92 and two transverse arches 98, 100 on the sole surface 86 cooperate such that footwear manufactured on last 70 spreads weight bearing and propulsion forces more naturally over the sole surface 86 as described in greater detail hereinbelow. The sole surface 86 of the invention is smoothly contoured to include the four arches in accordance with the principles of the present invention, and drastically deviates from conventional last technology which relies exclusively upon a flattened sole surface as illustrated in the prior art FIGS. of 5, 5A, 5B and 6.

All conventional last technology is driven by a flattened sole surface and by reference points and dimensions which are referenced to such a surface. The existence of a flattened sole surface creates a sharply-angled and rigid featherline 12 (see FIGS. 5 and 6). Last 70 of the present invention comprises a smooth and continuous transition between the top 80 and bottom 82 of the last and particularly between the sole surface 86 and upper surface 88. As clearly illustrated in FIG. 4, the smooth transition between sole surface 86 and upper surface 88 and the parting line 78 provides a last 70 which is free from a sharp and rigid last bottom featherline. The upper surface 88 defined above parting line 78 curves continuously to a defined upper surface centerline 102. Conversely, all portions on the smooth and contoured sole surface 86 below the parting line 78 curve to a defined sole surface centerline 103.

Figure 10:
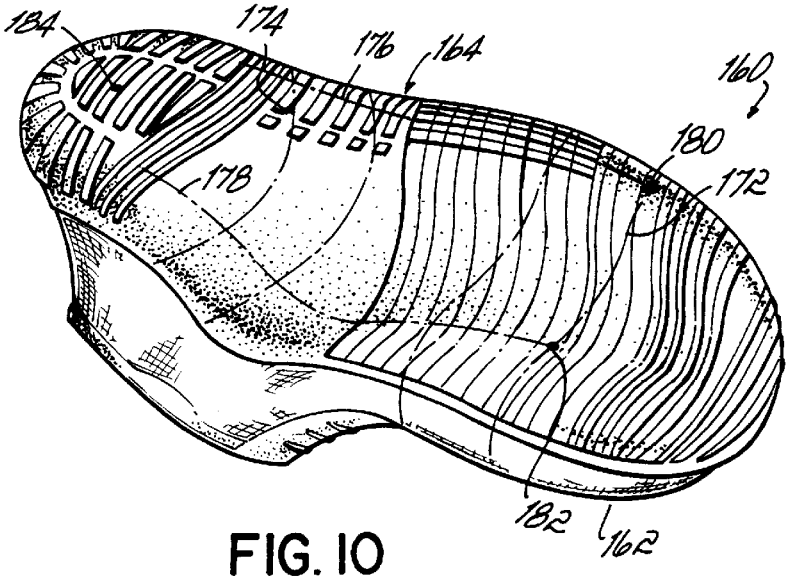
FIG. 10 is a bottom perspective view of footwear manufactured with the last of the present invention illustrating the unique contours and arches reflected by the sole surface of the inventive last.
Figure 11:
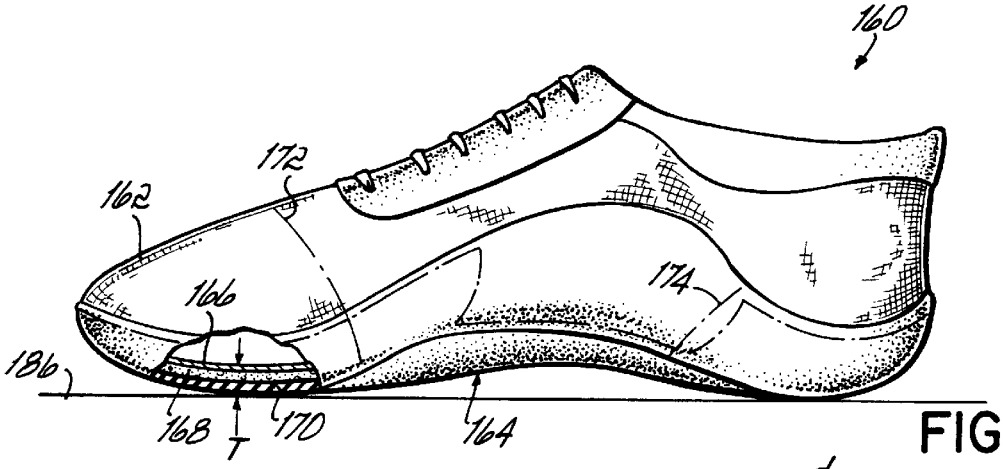
FIG. 11 is a side view, partially cut away, illustrating excellent footwear manufactured utilizing the inventive last and also the construction of such footwear.

Footwear manufactured utilizing the last 70 of the invention, incorporates the unique and inventive contour sole surface 86 and yields footwear which lacks a sharply angled feather edge around the periphery thereof between the sole surface and the upper surface (See FIGS. 10 and 11). The footwear thus manufactured is more comfortable to the human wearer than traditional footwear as the inside cavity of the footwear adopts the unique and inventive shape of last 70. It has been empirically determined that the last 70 produces footwear which works in harmony with the human foot to provide proper weight distribution and pressure. Footwear manufactured utilizing a conventional last with a flat sole surface and angled featherline provides flat, rigid shoe soles and a construction which pinches, binds and otherwise produces unnatural pressures on the foot. Furthermore, the footwear manufactured utilizing conventional lasts unnaturally distributes the pressures applied through the shoe sole to the foot of the wearer.

Figure 7A:
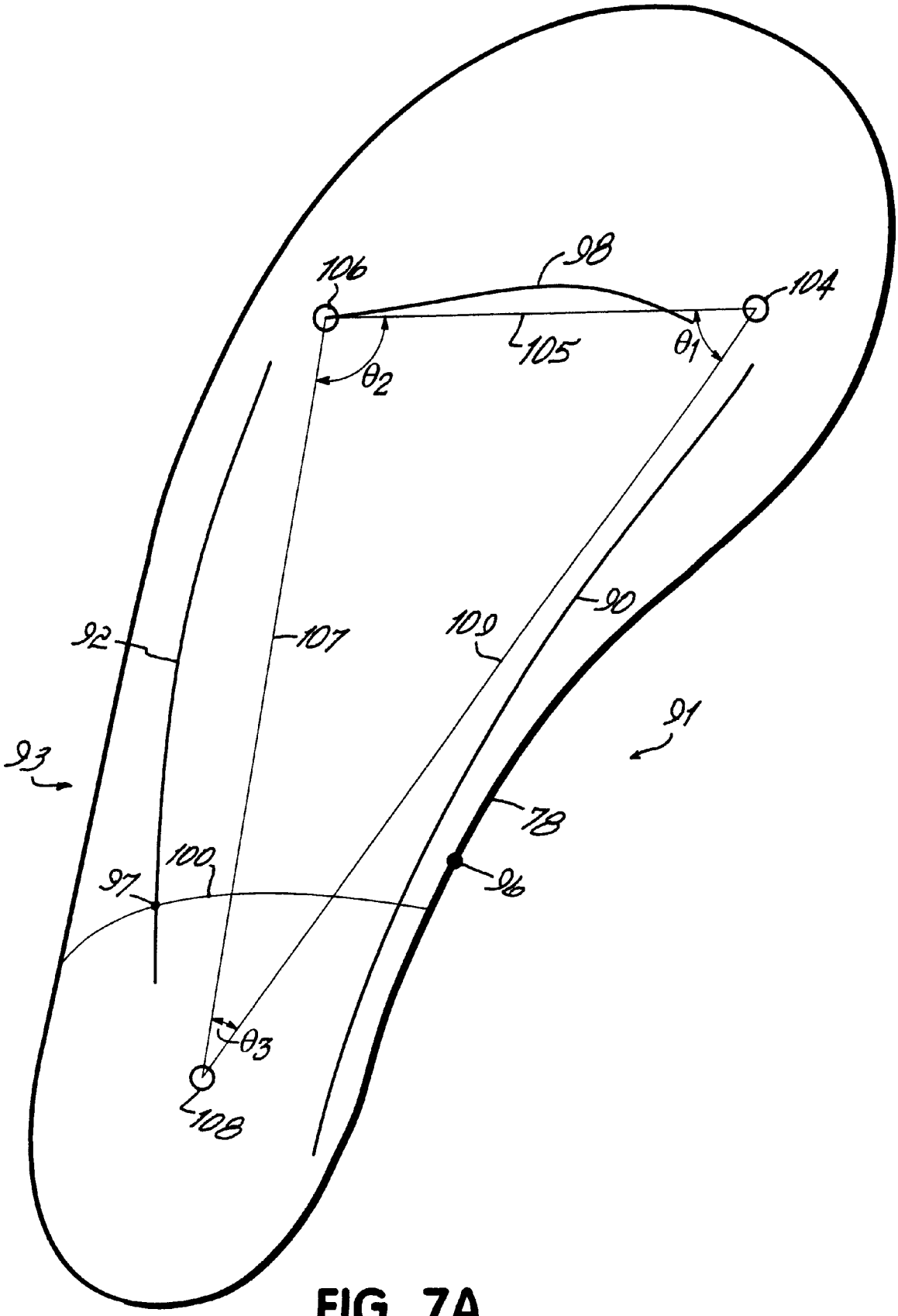
FIG. 7A is a diagrammatic view of the sole surface of the last of the invention illustrating the longitudinal and transverse arches and the contact points of the sole surface.

The interaction of the longitudinal and transverse arches on the bottom of sole surface 86 in accordance with the inventive aspects of last 70 combined with three distinct and discreet contact points on the sole surface 86. Referring to FIG. 7A, a first contact point 104 as located on sole surface 86 in the toe portion 74 of the last body 72. The first contact point 104 is proximate the forward end of the inward longitudinal arch 90 and the inner side of the forward transverse arch 98. The first contact point 104 is generally defined by the intersection of the inner longitudinal arch 90 and the forward transverse arch 98. The second contact point 106 is located proximate a forward end of the outer longitudinal arch 92 and at the outer side of the forward transverse arch 98 generally in the toe portion of the last body 72. The second contact point 106 is generally defined by the intersection of the forward transverse arch 98 and the outer longitudinal arch 92. The third contact point 108 is located in the heel portion 76 of the last body 72 proximate the rearward end of both the inner longitudinal arch 90 and the outer longitudinal arch 92 and rearward of the rearward transverse arch 100.

The contact points 104, 106 and 108 intersect the horizontal base plane 84 when the last body 82 is placed in an upright or primary position to rest upon the base plane 84 (see FIGS. 3 and 4). Thereby, the contact points 104, 106 and 108 support the last body 72 and essentially present the lowermost points on the last 70. As may be appreciated, the points 104, 106 and 108 are not infinitesimally small points on the sole surface 86 of the rigid last body 72. Rather, the contact points 104, 106 and 108 are in actuality very small contact areas which intersect the base plane 84. However, for the purposes of describing the present invention, the contact points 104, 106 and 108 are substantially small enough with respect to the cumulative surface area of the last sole surface 86 to be considered points.

The contact points are positioned in accordance with the principles of the invention, and as illustrated in FIG. 7A, straight lines connecting the contact points 104, 106 and 108 form a definable triangle on the sole surface 86 of last body 72. As such, angles are formed at each contact point by lines which extend to the other contact points. For example, angle $\theta_1$ is formed by line 105 from the first contact 104 to the second contact point 106, and line 109 from the first contact point 104 to the third contact point 108. Preferably, $\theta_1$ will be approximately 54°, but can generally be in the range of approximately 20° up to 120°. Angle $\theta_2$ is formed at the second contact point 106 by the line 105 between the second contact point and the first contact point, and line 107 between the second contact point 106 and the third contact point 108. Preferably angle $\theta_2$ is approximately 100°; but may generally be in the range of approximately 160° down to 50°. The angle $\theta_3$ associated with the third contact point 108 is formed by line 107 from the third contact point 108 to the second contact point 106 and by line 109 extending from third contact point 108 to first contact point 104. Preferably angle $\theta_3$ is approximately 26°, but may generally be in the range of approximately 1° up to 45°. The combination of the four arches 90, 92, 98 and 100, and the three contact points 104, 106 and 108 defined herein provides a unique sole surface 86 which yields footwear more in harmony with the natural human foot. Footwear manufactured with the last 70 of the invention provides stable support for the foot and also provides arches which may lengthen and contract as necessary to respond to the changing shape of the human foot during weight bearing and propulsion. A footwear sole contoured to the sole surface 86 of last body 72 does not have a flat; rigid platform as in traditional footwear which binds the foot and artificially supports the foot such that downward pressure is distributed unnaturally over the sole. The unnatural distribution of weight and propulsion forces creates foot discomfort and eventually foot and posture problems in the wearer.

The last 70 of the invention has a unique shape and a contoured sole surface 86 with four cooperating arches. The last 70 projects different effective cross-sectional areas onto a base plane 84 from different heights above the base plane. That is, at any given horizontal plane above the horizontal base plane 84, the last 70 will have a defined cross-sectional area. With the four unique arches and defined contact points at the intersection of the arches, the last, in accordance with the invention, exhibits cross-sectional areas which vary and generally increase at an increasing distance from base plane 84 in accordance with the unique shape of sole surfaces 86 up to the parting line 78. Because of the shape of the upper surface 88 of last 70, at a particular height above the base plane 84, the actual projected horizontal cross-sectional area may increase at one area of the last, but decrease at another area of the last. That is, the actual projected cross-sectional area will increase and decrease as the parting line 78 is reached in some areas but exceeded in others. Therefore, the last of the invention is best illustrated by reference to a cumulative cross-sectional area projected onto the base plane rather than an actual cross-sectional area. In referring to a cumulative cross-sectional area to illustrate sole surface 86, an assumption is made regarding the upper surface of the last. Essentially, as illustrated in FIG. 7D, the upper surface 88 of the last will be considered to extend vertically upwardly from the parting line 78. In that way, any increase of cross-sectional area accumulated in planes at increasing distances above the base plane 84 will not be offset by loss of cross-sectional area in certain areas of the last when the height of the horizontal plane exceeds the height of the parting line at a certain area on the last. That is, the curvature of the upper surface 88 above parting line 78 from the toe portion 74 to the heel portion 76 and the resultant loss of actual cross-sectional area is not taken into account when defining the unique sole surface 86 of the last 70 and the cross-sectional areas that it projects downwardly onto the base plane 84 from vertical heights above the base plane.

The maximum cumulative horizontal cross-sectional area projected onto base plane 84 is defined by the outwardmost points on the last body 82, and specifically the parting line 78 connecting those points. The cumulative horizontal cross-sectional area projected onto base plane 84 by the sole surface 86 of last body 72 further defines the unique and inventive contoured shape of the last 70 as described in greater detail hereinbelow.

Figure 7B:
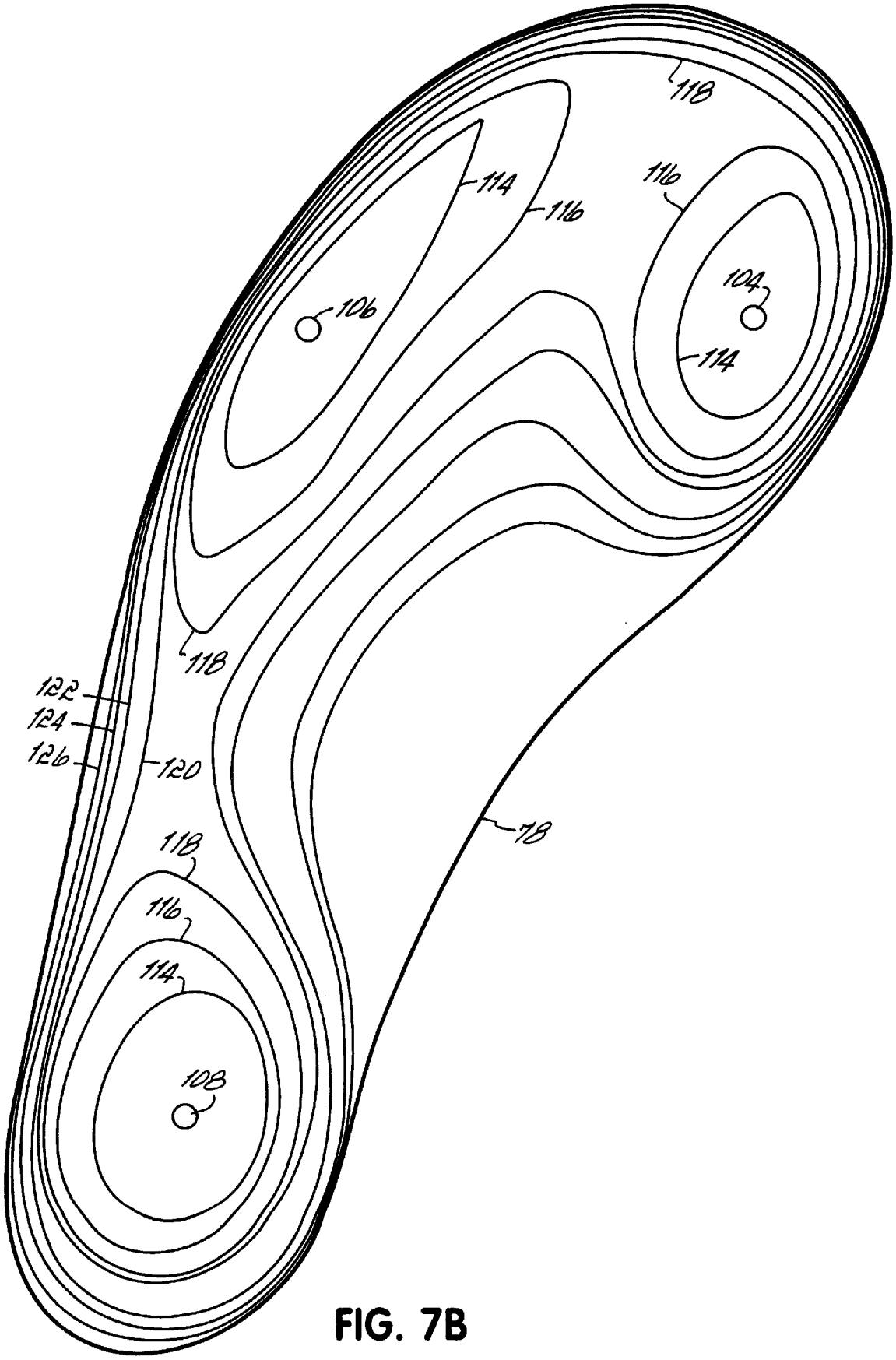
FIG. 7B is a diagrammatic view of the cumulative horizontal cross-sectional area projected onto a horizontal base plane at various heights above the base plane to illustrate the unique configuration of the contoured sole surface of the last and FIG. 7C is a similar diagrammatic view for other horizontal cross-sectional planes above the base plane.
Figure 7C:
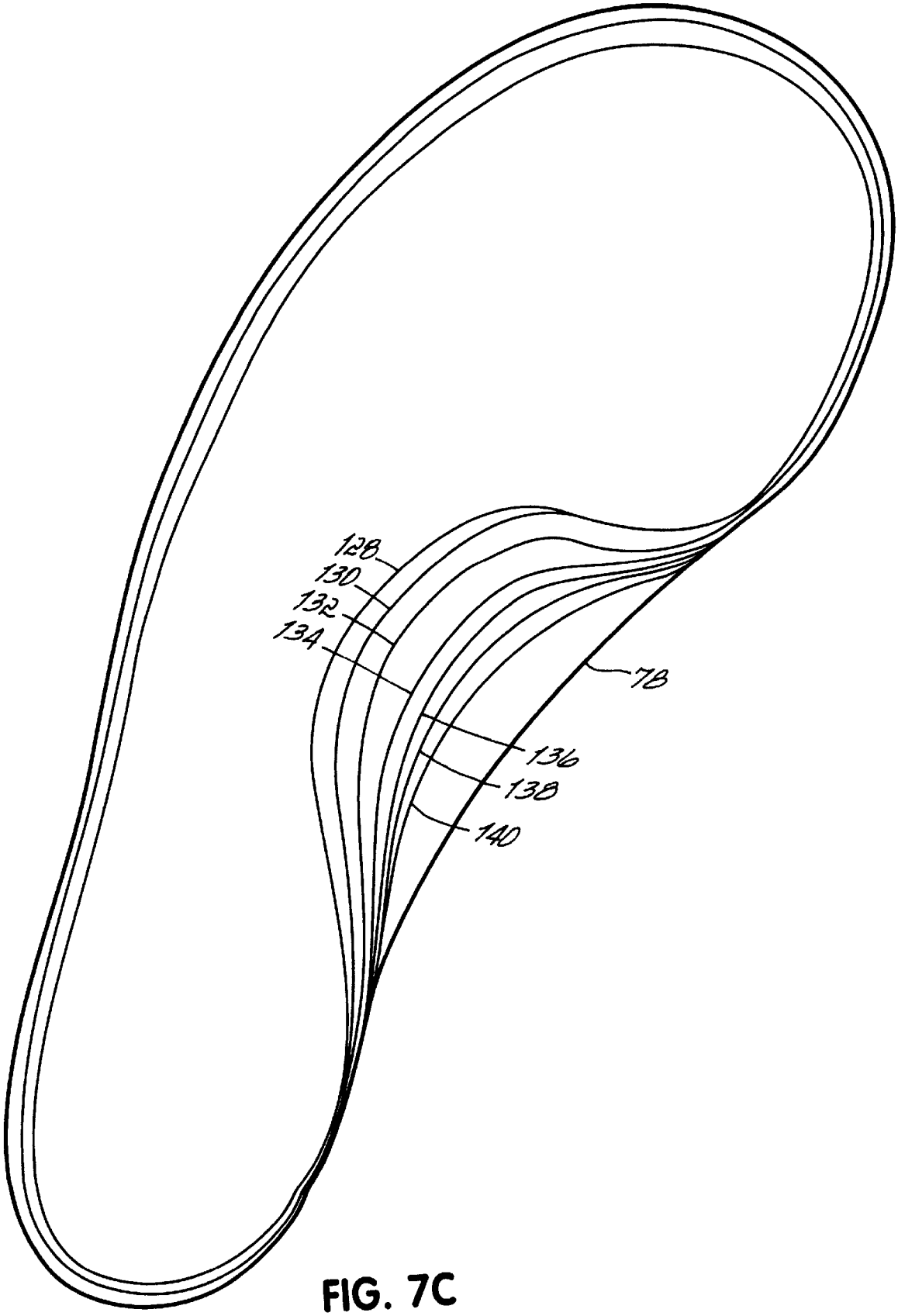
Figure 7D:
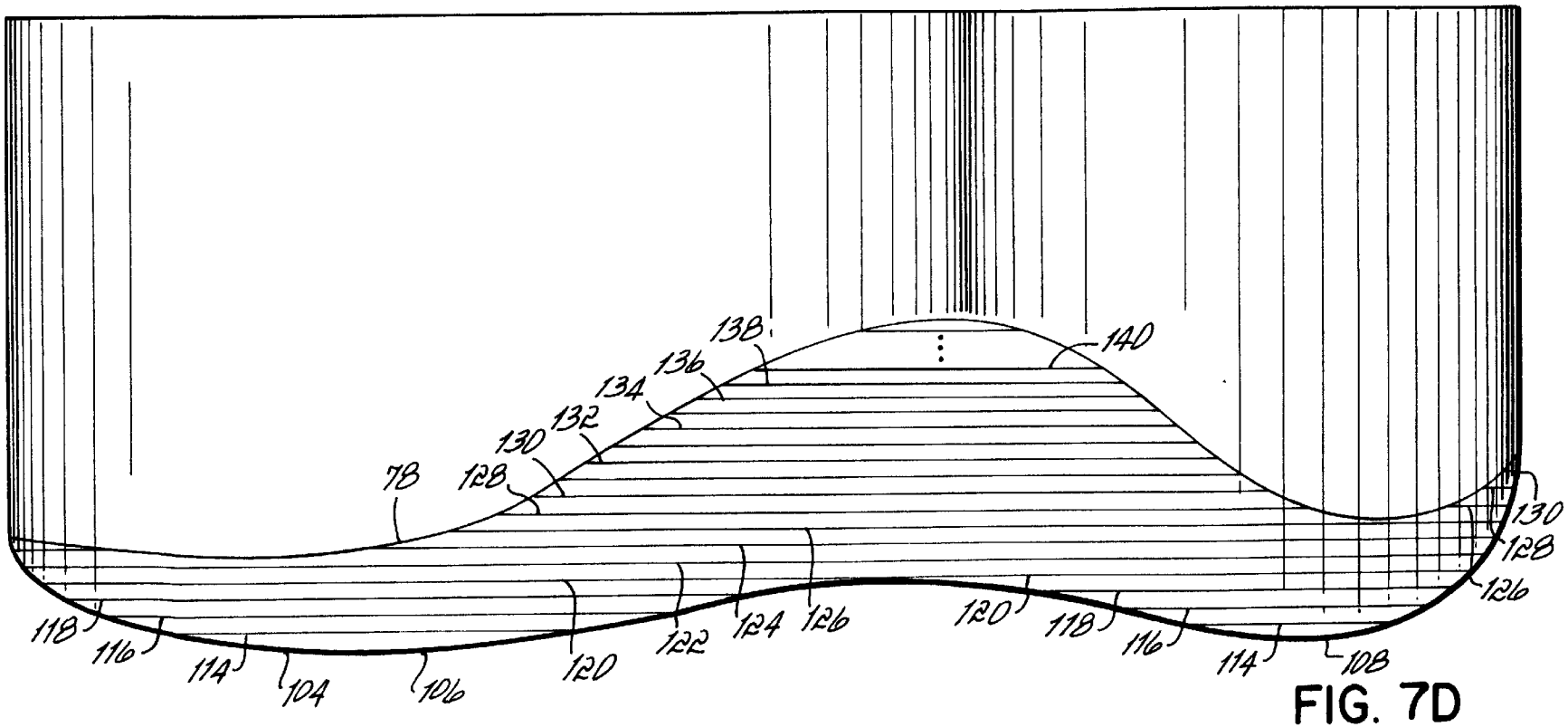
FIG. 7D is a side view of the last sole surface of the present invention illustrating the various horizontal cross-sectional planes yielding the horizontal cross sections illustrated in FIGS. 7B and 7C and further illustrating the parting line of the last.

FIGS. 7B and 7C illustrate contour lines of the sole surface 86 of last 70 of the invention which illustrate the cumulative, horizontal cross-sectional areas projected downwardly onto base plane 84 by the sole surface 86 at various horizontal contour cuts made at intervals above the horizontal base plane 84 as illustrated in FIG. 7D. In a horizontal cross-sectional cut made in accordance with lines of FIG. 7D, the sole surface 86 of last body 72 will project a cumulative cross-sectional area downwardly onto base plane 108. In accordance with the principals of the present invention, the cumulative cross-sectional area thus projected will increase as the distance above the base plane 108 is increased. As mentioned above, and as is illustrated more clearly hereinbelow, the true or actual cross-sectional area will increase up to a certain point and then will begin to decrease as the curves in the top surface 88 of the last cause a reduction in the actual projected cross-sectional area at certain areas on the last when the parting line 78 is exceeded. However, the cumulative cross-sectional area will continue to increase up to 100% until the parting line 78 is reached and exceeded everywhere on the last. Thereabove, the cumulative cross-sectional area projected downwardly on the base plane 84 is considered 100%.

As discussed above, the parting line 78 defines the series of outwardmost points of the last body 72 and thus is reflective of a maximum cumulative cross-sectional area projected downwardly onto base plane 84 of 100%. The last is described herein in terms of cumulative cross-sectional area projected downwardly onto base plane 84. However, it will be readily understood by a person of ordinary skill in the art, that the actual cross-sectional area of the last will increase in certain areas while decreasing in other areas the further the distance from the horizontal base plane 84 eventually resulting in a decrease in the actual cross-sectional area projected downwardly.

FIGS. 7B, 7C and 7D along with the figures in Table 1 below were made for on an embodiment of the last which measured 11 7/16 inches in stick length (the length from the forwardmost point 113 to the endmost point 112 [see FIG. 3]) on the parting line 78, 10 5/16 inches in joint girth (measured approximately around line 110), 4 5/16 inches in back cone height (illustrated by line 111 and measured from the base plane 84 to the top of the last body 72 [see FIG. 3]), and 2½ inches in height from the base plane 84 to the highest point 96 of the inner longitudinal arch 90 defined on the parting line 78. Point 96 defines a maximum arch height of 2½ inches. The maximum cumulative, horizontal cross-sectional area projected downwardly below the parting line of such a last was approximately 37 inches$^2$ (See Table 1)

Table 1 below illustrates, for the various horizontal contour cuts made at different heights above the base plane 84, the actual horizontal cross sectional surface areas projected onto the base plane, and the cumulative horizontal cross-sectional areas projected onto the base plane by the horizontal cross sections. The first column of Table 1 contains the heights above the base plane 84 for the particular horizontal cross sectional cuts as a raw number and percentage of the maximum arch height, and the second column contains the various reference numerals for reference to FIGS. 7B, 7C and 7D to illustrate the cuts. The third column contains the actual projected cross-sectional areas measured, and the fourth column denotes the actual cross-sectional areas of column three (3) as a percentage of the maximum cumulative projected cross-sectional area defined by the parting line 78 (i.e., approximately 37 inches$^2$). The fifth column lists the cumulative horizontal cross-sectional areas which, as described above, do not take into account the diminishing cross-sectional areas associated with the curvature of the top surface 88 of the last body 72 above parting line 78. The sixth column lists the cumulative horizontal cross-sectional areas as a percentage of the maximum cumulative horizontal cross-sectional area below parting line 78.

TABLE 1

| Ht. Abve Base Plane in. (% of max) | Ref. to FIGS. | Actual Projected Cross-Sectional (measured) Area in$^2$ | Actual Projected Cross-Sectional Areas as % of Maximum Cumulative Area | Cumulative Projected Cross-Sectional Area - Does Not Recognize Diminishing Toe Areas/Transverse Area in.$^2$ | Cumulative Projected Cross-Sectional areas as % of Maximum Cumulative Area |
|---|---|---|---|---|---|
| 0 | 108, 104, 106 | .5 | 1.4 | .5 | 1.4 |
| (2.5) 1/16 | 114 | 5 | 13.5 | 5 | 13.5 |
| (5.0) 1/8 | 116 | 10 | 27 | 10 | 27 |
| (7.5) 3/16 | 118 | 16 | 44 | 16 | 44 |
| (10.0) 1/4 | 120 | 21 | 57 | 21 | 57 |
| 5/16 | 122 | 24 | 65 | 24 | 65 |
| 3/8 | 124 | 26 | 70 | 26 | 70 |
| 7/16 | 126 | 27 | 75 | 27 | 75 |
| (20) 1/2 | 128 | 29 | 78 | 29 | 78 |
| 9/16 | 130 | 30 | 81 | 30 | 81 |
| (25) 5/8 | | 30 | 81 | 31 | 84 |
| 11/16 | 132 | 31 | 84 | 32 | 86 |
| (30) 3/4 | | 31 | 84 | 32 | 88 |
| 13/16 | 134 | 31 | 84 | 33 | 89 |
| 7/8 | | 31 | 84 | 33 | 89 |
| 15/16 | 136 | 31 | 84 | 34 | 92 |
| (40) 1 | 138 | 31 | 84 | 34 | 92 |
| 1 1/16 | 140 | 30 | 81 | 34 | 93 |
| (100) 2 1/2 | | | | 37 | 100 |

Table 1 and the contour lines referenced thereto and illustrated in FIGS. 7B and 7C show that at the base plane, three discreet and separated contact points or small contact areas are defined in combination with the four longitudinal and transverse arches of the sole surface 86. The cumulative horizontal cross-sectional area projected onto the base plane or generally in contact with the base plane is approximately 0.5 inches$^2$ or 1.4% of the maximum cumulative horizontal cross-sectional area defined at or above parting line 78 of FIG. 7D. The cumulative cross-sectional area projected by the three contact points 104, 106 and 108 onto the base plane should preferably be in a range of approximately 1% to 10% of the maximum projected area.

A longitudinal cross section through the last approximately 1/16 inch above the base plane 84 or approximately 2.5% of the maximum height of the inner longitudinal arch illustrated at reference point 96, reveals a cross section 114 with three discreet areas as illustrated in FIG. 7B. The areas indicated by reference numeral 114 cumulatively comprise an area of approximately 5 inches$^2$ or 13.5% of the maximum cumulative horizontal cross-sectional area projected onto the base plane 84. Preferably, the cumulative cross-sectional area project by areas 114 is in the range of approximately 10% to 20% of the maximum projected area.

The data and general shape associated with successive cross-sectional areas at interval planes above the base plane 84 are illustrated in Table 1 and in FIGS. 7B, 7C and 7D. The data and figures reveal a pattern of increasing cumulative cross-sectional area of the sole surface 86 of the last body 72. The inventive sole surface 86 is engineered to yield footwear which naturally accepts the forces and pressure of a wearer's foot and naturally distributes those pressures and forces similar to a bare foot without the distortion, binding and discomfort associated with conventional lasts and footwear manufactured thereon.

At a vertical height of 1/8 inch or 5% of the maximum arch height, a horizontal cross section projects an area of preferably approximately 27% of the maximum area or 10 inches$^2$. The cumulative cross-sectional area projected at that height is in the range of approximately 20% to 35% of the maximum projected area.

At a height of 3/16 inch above the base plane or 7.5% of the maximum inner longitudinal arch height, the discreet contact surfaces around contact points 104 and 106 become a single area in the toe portion 74 of last body 72 which partially extends rearwardly on the sole surface 86 along the outer longitudinal arch 92. The merging of the contact points 104 and 106 at 7.5% of the maximum arch height yields footwear which adapts to the dynamic shape of the foot during propulsion and weight bearing. Particularly, footwear manufactured on the last 70 of the invention accommodates the flattening of the human foot across the heads of the metatarsals and phalanges of the foot when weight is applied thereto. Areas 118 project approximately 16 inches$^2$ or 44% of the cumulative horizontal cross sectional surface area onto base plane 84. Preferably, the cumulative cross-sectional areas 118 is in the range of 35% to 50% of the maximum cross sectional surface area.

At a height of ¼ inch above the base plane, or 10% of the maximum arch height, the two discreet surfaces 118 previously illustrated by reference numeral 118 combine into a single continuous surface area 120 which connects the toe portion 74 and heel portion 76 along the outer longitudinal arch 92 as illustrated in FIG. 7B. This merging of the discreet surface areas and the contouring of the sole surface 86 of the last according to the principles of the present invention, is further in harmony with the flattening and spreading of the foot during propulsion and weight bearing. That is, footwear manufactured with the last 70 of the invention accommodates the further flattening of the foot along its length as the arches 90, 92 are flattened. Preferably the cumulative cross-sectional area 120 is in the range of 50% to 60% of the maximum cross-sectional area. Referring to Table 1, at 10% of the maximum arch height, the cumulative horizontal cross sectional surface area projected downwardly is approximately 21 inches$^2$ or 57% of the maximum cumulative horizontal cross-sectional area.

At a height of ½ inch or 20% of the maximum arch height, the cumulative horizontal cross-sectional surface area projected downwardly is preferably approximately 29 inches$^2$ or 78% of the maximum cumulative horizontal cross-sectional area. The cumulative cross-sectional area projected at that height is in the range of approximately 70% to 85% of the maximum projected area.

At approximately a height of ⅝ inch above the base plane or 25% of the maximum arch height, the cumulative horizontal cross-sectional area does not coincide with the actual cross-sectional area due to the curvature of the upper surface 88 of the last body 72. That is, while there is an increase in horizontal cross-sectional area in some regions of the last, there is a diminishing projected cross-sectional area in other regions indicating that the parting line 78 has been exceeded in those regions. As illustrated in FIG. 7D, the parting line is at various different heights above the base plane 84 around the last 70. For example, while the projected horizontal cross-sectional area in the toe portion 74 may decrease, the projected horizontal cross-sectional area in the region of the intersection between transverse arch 100 and the longitudinal arches 90, 92 would increase because the maximum horizontal cross-sectional area which is projected by the inner longitudinal arch is not achieved until the parting line is reached or exceeded, such as at the arch maximum height or reference point 96, at all areas of the last. At the ⅝ inch height, 81% of the maximum area is actually exposed. However, as discussed above, the cumulative horizontal cross-sectional area is greater and is approximately 84% of the maximum.

At a height of ¾ inch or 30% of the maximum arch height, the cumulative horizontal cross-sectional surface area projected downwardly is preferably approximately 32 inches$^2$ or 88% of the maximum cumulative horizontal cross-sectional area. The cumulative cross-sectional area projected at that height is in the range of approximately 85% to 90% of the maximum projected area.

At a height of 1 inch above the base plane or approximately 40% of the maximum arch height, the cumulative horizontal cross-sectional area 138 projected is preferably approximately 34 inches$^2$ or 92% of the maximum cumulative horizontal cross-sectional area. However, at that height above the base plane 84, the actual horizontal cross-sectional area projected downwardly onto the base plane is only approximately 31 inches$^2$ or 84% of the maximum cumulative cross-sectional area. Preferably, the cumulative cross-sectional area 138 is in the range of 90% to 93% of the maximum cross-sectional area.

The remaining 60% of the inner longitudinal arch height, which occurs in the additional 1½ inches above the 1 inch cross section 138 previously discussed, reveals the final approximately 7% of the maximum horizontal cross-sectional area. The 100% horizontal cross-sectional area projected onto base plane 84 occurs at approximately 2.5 inches above the base plane 84 as indicated by point 96 when the maximum height of the inner longitudinal arch 90 is reached. However, the actual horizontal cross-sectional area exposed at this height will be substantially less than 100% as the entire toe portion 74 of the last and a recognizable amount of the heel portion 76 of the last 70 will have receded and will not be projected onto base plane 84 as part of a horizontal cross-sectional area.

Figure 5:
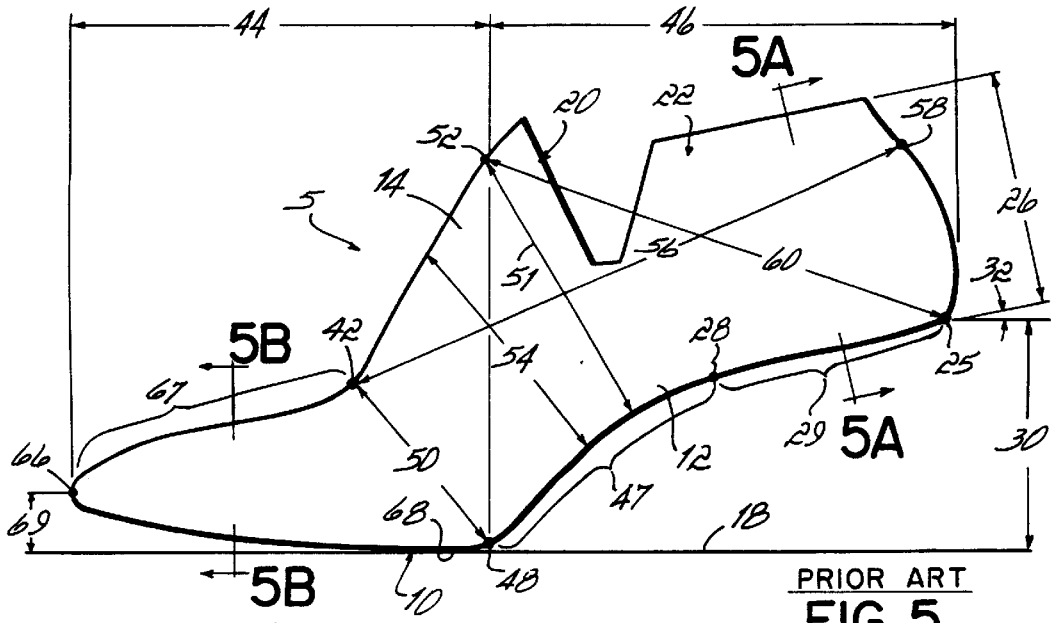
PRIOR ART FIG. 5
FIG. 5 is a side view of the prior art last illustrating numerous reference points, reference planes, and dimensions of conventional last technology.
Figure 5A:
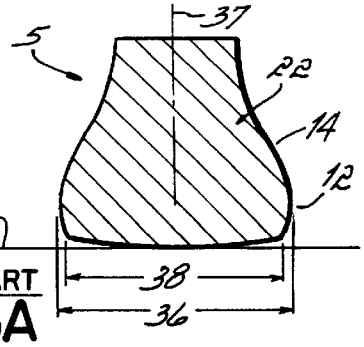
PRIOR ART FIG.5A
Figure 5B:
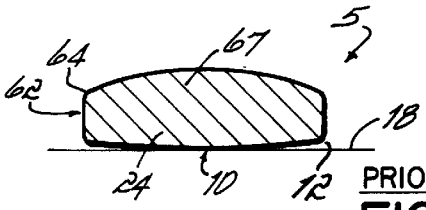
PRIOR ART FIG.5B
FIG. 5B is a cross-sectional view taken along lines 5B—5B of FIG. 5.
Figure 6:
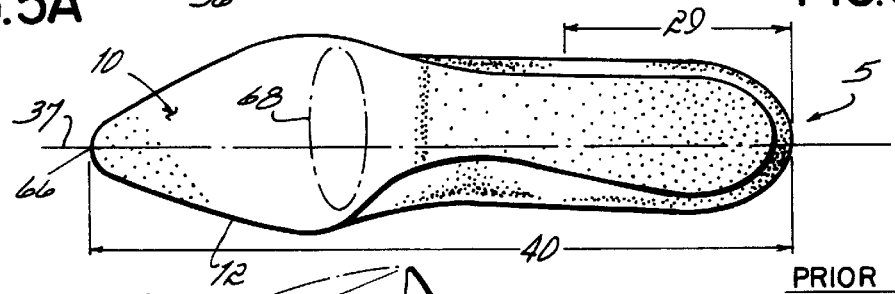
PRIOR ART FIG. 6
FIG. 6 is a bottom view of the prior art last of FIG. 5 illustrating the flattened sole surface and the sharply-angled featherline of conventional lasts.
Figure 6A:
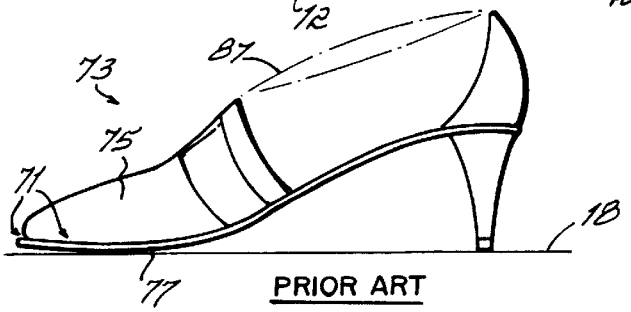
PRIOR ART FIG.6A
Figure 6B:
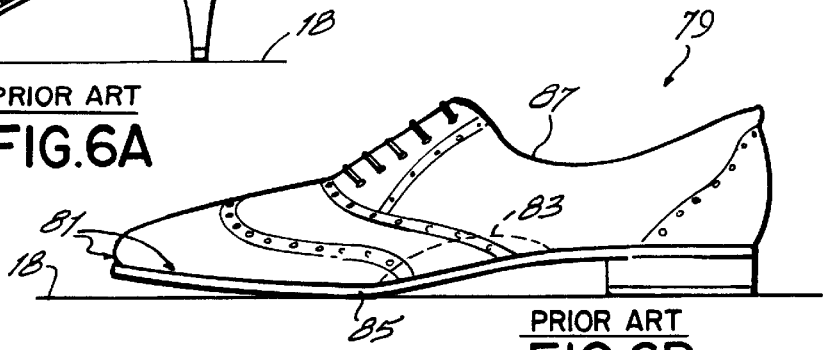
PRIOR ART FIG.6B
FIG. 6B is a side view of a conventional men's shoe built on a last similar to the last of FIGS. 5 and 6.

Referring again to FIG. 3, the contact points 104, 106 and the contact point 108 lie in substantially the same plane, i.e., there is no heel elevation in the last of the present invention. As illustrated in FIG. 5, conventional lasts have heel seats 29 which are in a plane vertically elevated above the plane of the toe portion 67 of a conventional last. The resulting heel elevation 30 requires a stiff heel to be added to the bottom of conventional footwear to support the heel of the wearer and to make the footwear function properly as illustrated in FIGS. 6A and 6B. The lack of heel elevation in last 70 of the present invention eliminates the need to have a stiff heel placed beneath the sole of the resulting footwear to make the footwear function properly. This provides a last 70 and footwear that is further in harmony with the natural shape and movement of a human foot. Additionally, the stiff, heel-elevated, sole platform that is necessary with conventional lasts causes ankle and foot injuries and exacerbates existent injuries, because the human foot in motion has a tendency to roll or fall off of the stiff platform which may be elevated an inch or more above the ground because of the heel. With footwear manufactured on last 70, there is no stiff, elevated sole platform beneath the foot, and the moving foot has a tendency to roll inwardly or outwardly like the bare human foot reducing the many foot and ankle injuries caused by shoes with flattened soles.

As illustrated in FIG. 7A, the rearward transverse arch 100 and inner longitudinal arch 90 intersect. The transverse arch 100 rises as it extends from the outer side 93 to the inner side 91 of last 70 to reach its maximum vertical height also proximate point 96 at the inner side 91 of last 70. Transverse arch 100 has its lowest vertical height at the outer side 93 of last 70 approximately at the point of intersection 97 with outer longitudinal arch 92. Therefore, both the longitudinal arch 90 and transverse arch 100 reach their maximum vertical height proximate point 96 at the inner side 91 of last 70. The combination of intersecting arches, 90 and 100, and the simultaneous rise in height traversing across the width of sole surface 86generally simulates the natural in-step arch of a human foot, and, as a result, presents a sole surface 86 closely in harmony with a natural human foot.

In accordance with the principles of the present invention, the maximum vertical height of the arches, 90 and 100, from base plane 84, is approximately 10% to 30% of the total length of the last 70 or stick length from point 112 to point 13. The maximum height at point 96 is measured at a distance from point 112 which is approximately ⅓ the total length or "stick length" of last 70.

The stiff, flat sole platform which is necessary in footwear manufactured using conventional lasts, when placed against a human foot, results in a gap between the foot and the platform due to the natural in-step arch of the foot. To compensate for this gap in footwear manufactured using conventional lasts, a mass of material 83 is usually placed between the sole platform and the inside of the foot (See FIGS. 6A and 6B). This mass is placed therein under the pretense of giving arch support to the foot. However, the healthy natural human foot does not need additional arch support. This mass of material actually prevents the human foot from flexing properly, as it is intended to do. Therefore, the combination of arch mass and a stiff flattened sole platform results in a disharmony between the human foot and footwear manufactured using conventional lasts. On the other hand, footwear manufactured using last 70 of the present invention, due to the combination of the longitudinal and transverse arches has a bottom sole surface which eliminates the necessity of placing an artificial mass of material above the sole of the shoe to reinforce and bolster the foot's in-step arch.

Figure 2:
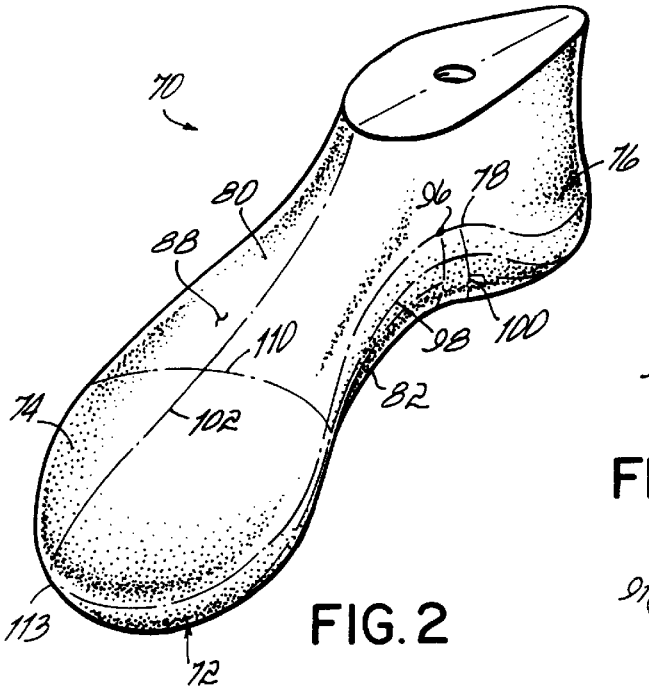
FIG. 2 is a top perspective view of the last of the present invention.
Figure 3A:
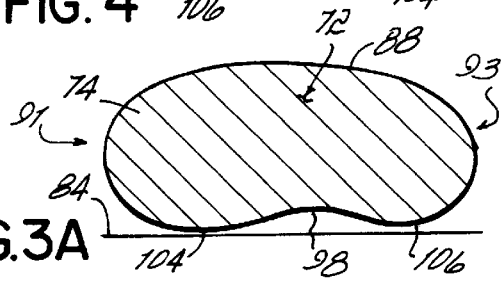
FIG. 3A is a cross-sectional view taken on lines 3A—3A of FIG. 3.
Figure 3:
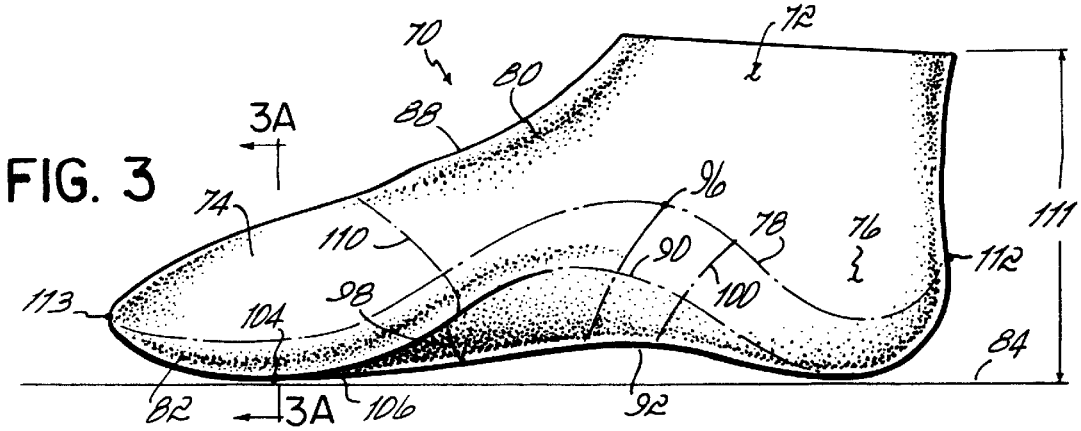
FIG. 3 is a side elevational view of the last of the present invention illustrating the inner and outer longitudinal arches.

Referring now to FIGS. 3A and 4, last 70 gradually tapers in thickness when moving from inner side 91 to outer side 93. This side-to-side taper reflects the decreased thickness of the toes from the big toe to the smallest toe on the human foot. Therefore, the smallest toe thickness of toe portion 74 is proximate to outer side 93 while the greatest toe thickness of toe portion 74 is proximate inner side 91. Additionally, as may be seen in FIGS. 1, 2 and 7A, the length of toe portion 74 gradually decreases on last 70 moving from inner side 91 to outer side 93. This gradual decrease in the length of last 70 reflects generally the natural length difference on the human foot between the big toe and the smallest toe.

The bio-mechanics of the human foot, both statically (when the foot is at rest), and dynamically (when the foot is moving), have been studied. The physical functioning of the foot is discussed in applicant's patents, U.S. Pat. Nos. 4,619,058 and 4,942,678 which are incorporated herein by reference. While the above described shoe last discloses a last which is longer and wider than the predetermined static foot for which the last would be used to make a shoe, in accordance with the principles of the present invention, it has been empirically determined that the dimensions of the inventive last and footwear should increase by specific amounts over the size of the foot for which the last is used in order to more closely mimic the natural spread and dimensional increases of the foot structure from when the foot is static to when it is dynamic. In other words, a last which is used to make a shoe for a defined static foot size, is made by dimensioning the last such that it is larger than the defined foot by certain empirically determined amounts. In this way, the last 70 of the present invention has both a uniquely shaped surface 86 and dimensions which are related to both the static and the dynamic shape of the foot.

When designing a last to build a shoe, a measure of foot length is defined as a reference and is assigned a foot size number. For example, column 1 of Table 2 below assigns a particular foot size number to a measurement of foot length to yield a foot length reference which is used to make the last. Table 2 is one example of a series of foot length references and associated foot size numbers which might be used in the last industry when designing lasts for making shoes to fit a particular size foot. A shoe-making last is formed and dimensioned using a chosen foot length reference so that a shoe manufactured using the last fits a foot which has a length that is approximately the same as the predetermined foot length reference. Since a foot size number may be associated with each foot length reference used to make the last 70, the last 70 yields footwear which may be referred to by the foot size number of the last as opposed to its actual length. The foot size number is what consumers generally use when purchasing shoes to fit their feet. Table 2 below illustrates one example of a foot size number-to-foot lenght reference relationship:

TABLE 2

SELECTED HUMAN FOOT LENGTH REFERENCES AND POSSIBLE CORRESPONDING FOOT SIZE NUMBERS

| Foot Size Number | Foot Length Reference (Inches) |
|---|---|
| . | . |
| . | . |
| 0 | 7-¼ + 1/32 |
| 2 | 7-15/16" |
| . | . |
| . | . |
| . | . |
| 3 | 8-¼ + 1/32 |
| 4 | 8-⅝ |
| 5 | 8-15/16 |
| 6 | 9-¼ + 1/32 |
| 7 | 9-⅝ |
| 8 | 9-15/16 |
| 9 | 10-¼ + 1/32 |
| 10 | 10-⅝ |
| 11 | 10-15/16 |
| 12 | 11-¼ + 1/32 |
| . | . |
| . | . |
| . | . |
| . | . |
| 15 | 12-¼ + 1/32 |
| . | . |
| . | . |

As seen in Table 2, a foot size number of 7 has been assigned to correspond to the foot length reference of 9⅝ inches. Therefore, a last assigned a foot size no. 7, would theoretically produce a shoe which fits a human foot which is approximately 9⅝ inches in length. In turn, the shoe made from a size 7 last will be designated as a size no. 7. Half sizes will generally correspond to a foot length reference which falls between the foot length references given in Table 2.

It may be appreciated that different styles of shoes may fit differently, and therefore, a consumer that fits into a shoe of one size of a particular style may not fit into that same size in a shoe of a different style. It may also be appreciated that the assigned foot size numbers are relative and for reference only and may be shifted upwardly and downwardly such as by making a foot size 9, instead of foot size 7, correspond to a foot length reference of 9⅝ inches. The reference lengths and size numbers shown in the chart above are utilized by some footwear manufacturers. There are numerous other reference scales that exist for assigning a size to a particular human foot length; some metric, some English, some unique unto themselves. All, however, can be translated or converted to correspond closely with Table 2. The reference point for all of the reference scales is an accurate measurement of the length of the human foot.

Conventional lasts often yield footwear that restricts the foot because among other reasons, they utilize a static foot length reference without recognizing the dynamic components of the foot. The shoe last 70 of the present invention takes into account the dynamic factors of the foot during such motions as walking and running. Through studies of the human body, the applicant has empirically determined various dimensions of the human foot which increase during motion, principally length and ball circumference. The last of the present invention reflects these dimensional changes to yield a shoe last which conforms to the dynamic physiological structure of the foot more precisely than those conventional lasts, which do not take into account the dynamic dimensional increases nor have contoured surfaces and a sole surface free of a last bottom featherline.

Through studies of the human foot, the applicant has empirically determined that a last must be increased to be longer than the predetermined static foot length reference by approximately 3–10%. A last 70 increased by such an amount over a particular foot length reference produces a shoe which fits a human foot having a length approximately the same as the foot length reference, and thus yields a shoe which may be referred to with the predetermined foot size number assigned to that foot length reference. However, unlike a conventional last, last 70, dimensioned as such yields shoes which take into account the dynamic shape of the foot as well as the static shape. For example, referring again to foot size no. 7, in Table 2, the corresponding foot length reference of 9⅝ inches is increased to yield a last length reference which is approximately 9.91 to 10.59 inches. This last length reference is utilized to make last 70. For each successive foot size number and corresponding foot length reference, the last length reference of the present invention is found by adding 3–10% to the foot length reference. The actual increase of the last length references will depend upon the style of shoe to be made with the last.

Table 3 below shows a series of foot size numbers with corresponding foot size references and one set of associated last length references which were generated in accordance with the principles of the present invention. Column four of Table 3 indicates the specific percentage increase of the foot length reference which would yield the associated last length reference of last 70 as shown in column three. As seen in column four of Table 3, as the assigned foot size number increases, the corresponding last length reference reflects a decreasing percentage length increase over the foot length reference. For example, a foot size number 2 designates a foot length reference of 7 15/16 inches and a corresponding last length reference of 8 35/64 inches which corresponds to an increase over the foot size reference of approximately 7.68%. Foot size number 15 and the associated foot length reference of 12¼+1/32 inches corresponds to a last length reference of 12 57/64 inches which corresponds to an increase of 4.96% over the foot length reference. However, this is not necessarily always the case as the increasing sizes may correspond to graduated increases of the foot size reference so that the percentage increase remains fairly constant or increases. Table 3 only gives one example of length increases.

TABLE 3

| | EXAMPLE TABLE OF POSSIBLE LAST LENGTHS FOR VARIOUS FOOT SIZE REFERENCES | | |
|---|---|---|---|
| Size | Foot Size Reference (Inches) | Last Size Reference (Inches) | (%) |
| . | . | . | . |
| . | . | . | . |
| 2 | 7-15/16 | 8-35/64 | 7.68 |
| . | . | . | . |
| . | . | . | . |
| 5 | 8-15/16 | 9-35/64 | 6.82 |
| 6 | 9-¼ + 1/32 | 9-57/64 | 6.57 |
| 7 | 9-⅝ | 10-15/64 | 6.33 |
| 8 | 9-15/16 | 10-35/64 | 6.13 |
| 9 | 10-¼ + 1/32 | 10-57/64 | 5.93 |
| 10 | 10-⅝ | 11-15/64 | 5.74 |
| 11 | 10-15/16 | 11-35/64 | 5.57 |
| 12 | 11-¼ + 1/32 | 11-57/64 | 5.40 |
| . | | . | |
| . | | | |
| . | | . | |
| . | | | |
| 15 | 12-¼ + 1/32 | 12-57/64 | 4.96 |
| . | | . | |
| . | | | |
| . | | . | |
| . | | | |

Therefore, in accordance with the principles of the present invention, the length of last 70, which is referred to as the stick length and is measured in a straight line between points 112 and 113, is increased to be longer than the predetermined foot length reference to which the last corresponds. A shoe produced from a last made using the last length reference is made to fit a human foot which has a length approximately the same as the initial foot length reference. The increase in the length of the last as indicated by the last length reference incorporates the static adjustments necessary to allow the wearer to insert their foot into the shoe, the increase in foot volume that may occur from the beginning to the end of a day, varying sock thickness or other static changes including weight gain or varying levels of activity.

The dynamic lengthening and widening components of the foot in motion are accommodated by the four arches which are an integral part of the invention. Basic mathematics demonstrate that a curved line between two points is longer than a straight line between the same two points. The four arches of footwear manufactured on the last of the invention flatten when the wearer walks, runs or stands. This flattening of the arches both lengthens and widens the shoe to accommodate the lengthening and widening foot. These static and dynamic, lengthening adjustments provide a last 70 which yields footwear that corresponds to a human foot better than footwear from conventional lasts. As seen from Table 3, the increase of the foot length reference yields a last length reference that is generally between 3 and 10% above the length of comparable foot sizes. However, the actual percentage increase of the foot length reference to yield a last length reference may be varied by a person of ordinary skill in the art to yield a last length reference outside of the preferred percentage ranges without departing from the scope of the present invention.

Referring to FIG. 3, the stick length of last 70 is measured from the end point 112 to the end point 113. In accordance with the principles of the present invention, the increase in last length from the predetermined foot length reference is not made only in the toe portion 74 so as to yield a longer toe portion, but rather, the last 70 is increased along the entire stick length of the last body 72. It has been physiologically determined that when a foot increases in length due to weight bearing and motion and the transverse and longitudinal arches flatten, the longitudinal arch of the foot generally moves both forward and backward as it is depressed downwardly from above. Therefore, when increasing last 70 from a foot length reference in order to yield a last length reference for the present invention, the increase in length is made both forwardly of the last 70 in the toe portion 74 and rearwardly in the heel portion 76, and generally equally in both directions from approximately around point 96.

Figure 8:
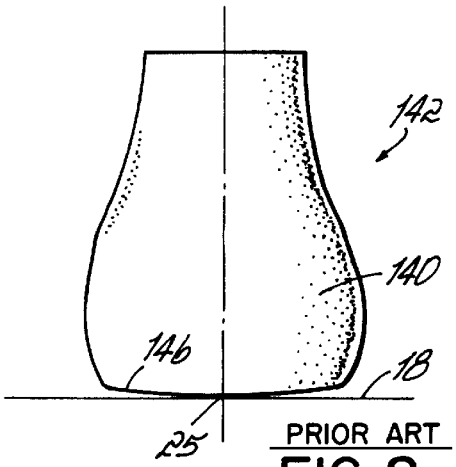
PRIOR ART FIG. 8
FIG. 8 is a rearview of a prior art conventional last illustrating the perpendicularity of the heel centerline utilized with all conventional lasts.

The last 70 of the present invention deviates from conventional last technology not only in the shape of the contoured sole surface 86, but also in the orientation of the heel portion 76 of the last. FIG. 8 illustrates a rear view of the heel 140 of a conventional last 142. The heels of conventional lasts are designed symmetrically on either side of a heel center line 144. That is, there is generally the same shape on either side of the center line 144. Furthermore, the flattened heel seat 146 is squared to be generally parallel to the base plane 18 and is perpendicular to the heel center line 144. Because the heel 140 is essentially squared off with the flat heel seat 146 perpendicular with the center line 144, conventional lasts produce footwear which has a similar symmetric heel and which binds and constricts the heel of the wearer to produce discomfort and irritation.

Figure 9:
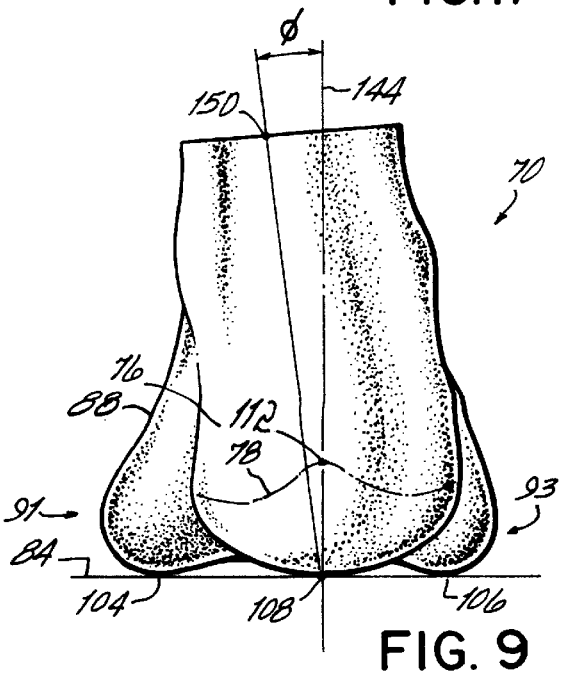
FIG. 9 is a rearview of the last of the present invention indicating the angle formed by the heel centerline with respect to the horizontal base plane and a conventional perpendicular center line.

The last 70 of the invention is not perpendicular to a defined heel center line 144 but is generally canted to one side of the centerline as illustrated in FIG. 9. The heel portion 76 is shown resting on a base plane 84 and making contact with the base plane only at the third contact point 108. The rearwardmost point 112 of last 70 in the lower end of the heel portion 76 is located on the parting line 78. The rearwardmost point in the top end of the heel portion 76 is designated by reference numeral 150. A straight line connecting the lower rearwardmost point 112 with the upward rearwardmost point 150 forms an angle ⊕. That is, the heel portion of last 76 is angled with respect to base plane 84 and with respect to a perpendicular heel center line 144. The angle formed by line 152 with respect to the center line 144 is generally between 2° and 10° and preferably will be approximately 6–7°. In other words, line 152 is not squared off or perpendicular to base plane 84 but is angled approximately 83°–84° with respect to base plane 84, and preferably in a range of 80° to 88° from the base plane. Footwear manufactured utilizing the angled heel portion 76 of the last 70 of the invention thus does not constrict and bind on the heel of a wearer and thus provides greater comfort with less irritation.

FIGS. 10 and 11 illustrate footwear manufactured with the last 70 of the invention. In accordance with the principles of the invention, the footwear incorporates the unique characteristics of the last 70 to thus provide footwear which is bio-mechanically more in harmony with the human foot than is footwear manufactured on a conventional last in accordance with the principles of the invention, the shoe 160 may be constructed in a number of ways as understood by a person of ordinary skill in the art. One way is slip lasting construction described as follows.

The desired upper 161 of the footwear is totally, or fully, closed to a soft leather or other appropriate bottom sock liner 166. Pattern cutting and stitching must be of a high standard to achieve a tight, wrinkle-free fit when the last is forced into the upper. Numerous pattern notches must be included on the upper and sock liner to achieve exact fit when the pieces are stitched together. Any slight discrepancy will result in the upper being out of balance when the last 70 is inserted.

If the fully lasted upper and sock liner have been properly cut and stitched, and if they have been made of appropriately supple and flexible materials, then upon insertion of the last 70 the material will conform to all of the contours and arches existing on the upper and lower surfaces of the last of the invention, without gaps, puckers or wrinkles.

Having forced the last 70 into the fully slip-lasted upper 161, a foam inner-sole 166, (of defined thickness, density and material dependent upon intended application of the footwear) is directly attached along the full length and breadth of the bottom of the sock liner 166 (See FIG. 11). Such inner sole 168, if of appropriate materials and correctly attached also conforms to all of the contours of the last bottom. The exterior edge of the foam is wrapped or ground to mimic and conform to the smooth transition from bottom to upper on the last 70 of the invention.

Following attachment of the inner-sole 168, a molded outsole 170 of desired material and dimensions is directly attached to the bottom of the inner sole 168. The outer sole 170 should smoothly wrap around the sides of the inner sole 168 and upward around the sides, front and back of the footwear to a height of not less than the parting line 78. Upon drying of the adhesive, the fully assembled footwear 160 may be removed from the last 70 and the outer sole 170 may be side-wall stitched to completely and permanently join all the components in a durable unit.

Other finishing or assembling steps may be added, or needed, to accommodate specific applications for differing kinds of footwear. Such steps will be apparent to a person of ordinary skill in the art.

Referring FIG. 11, the completed footwear 160 is shown broken away in the toe portion 162 of the shoe. The various layers of the shoe are illustrated and the layers are preferably of uniform thickness throughout the length of the shoe so that the sole surface 164 of shoe 160 follows the unique contours and shape of the last. For example, the sock layer of leather 166 might be approximately 1/64 in. while the layer of foam 168 is approximately ½ in. The outer sole which makes contact with the ground surface might be ⅛ in. of rubber or another suitable material.

Referring now to FIG. 10, the completed footwear 160 has a sole surface 164 which reflects the unique arches and shape of last 70. In particular, sole surface 165 has a forward transverse arch 172, a rearward transverse arch 174, a inner longitudinal arch 176 and an outer longitudinal arch 178. As with last 70, the arches 176, 178 are illustrated as lines but as may be appreciated, the arches exhibit width as well as length. The four arches are integrated on the last 70 to form smooth continuous surfaces without apparent delineation. The longitudinal arches 176, 178 and the transverse arches 172, 174 cooperate to form three contact points 180, 182 and 184 for footwear 160 similar to the contact points on last 70. When the shoe is worn by a wearer and makes contact with the ground, as illustrated in FIG. 11, the three contact points 180, 182 and 184 define the initial contact with a ground surface 186. As pressure from propulsion and weight bearing is exerted on sole surface 164 of the footwear 160, the transverse arches 172, 174, but primarily arch 172 operates to promote expansion of the shoe outwardly to either side. This takes into account the natural broadening of the human foot during propulsion and weight bearing. Therefore, footwear 160 of the invention does not unnaturally constrict or bind the foot as do conventional shoes manufactured on conventional lasts which have flat, rigid sole surfaces. Similarly, the longitudinal arches 176, 178 cooperate to increase the length of footwear 160 forwardly and rearwardly during propulsion and weight bearing. The longitudinal arches 174, 176 essentially flatten out when pressure is exerted on the footwear 160 and thus lengthen the footwear. The lengthening of the footwear is further in harmony with the natural expansion of the human foot and thus provides comfort and stability to the wearer without unnatural binding.

Footwear 160 of the invention, as illustrated in FIGS. 10 and 11, has a sole or sole surface 164 which has essentially a uniform thickness T along the entire length of the footwear 160. For example, if the thickness of the leather material 166, foam material 168, and rubber material 170, are maintained of uniform thickness throughout their length, which is preferable, the foot of a wearer (not shown) is maintained at a predetermined distance from the ground 186 throughout the entire length of the footwear 160. That is, no portion of the foot will be elevated unnaturally above another portion of the foot. For example, conventional lasts produce footwear which will maintain different areas of the human foot at different distances above a ground plane. For example, referring to FIG. 6B, the heel region of the foot will be maintained at a higher elevation than the toe area because of the heel which is necessary with shoes constructed on a conventional last. Furthermore, the middle of the foot is held in an artificially elevated position above the heel and toe portions of the foot by arch support 83 during static and dynamic positions of the foot. Therefore, conventional footwear binds and artificially supports the foot creating discomfort and physical problems. The footwear 160 of the invention addresses such shortcomings of the prior art and maintains all areas of the foot at a uniform height above a ground plane similar to the position the foot would maintain when bare without any footwear thereon. The combination of arches in the footwear 160 of the invention further enables the footwear to accommodate the widening and lengthening of a foot during propulsion and weight bearing. The compliant materials utilized for the sole layers 166, 168 and 170 provide expansion and contraction which is not capable with the design of conventional footwear and the rigid, flattened soles which must be utilized therewith.

Furthermore, the footwear 160 of the invention, with a uniformly thick sole will project horizontal cross-sectional areas similar to those discussed hereinabove with respect to last 70. That is, the projected cumulative horizontal cross-sectional areas will increase at increasing vertical heights above a ground plane 186 until a maximum is reached at the maximum inner longitudinal arch height in accordance with the inventive aspects of the last 70 described above.

It has been empirically determined that the footwear 160 manufactured with last 70 in accordance with the principles of the invention provide the distribution of weight and pressure as very close to the distribution as achieved by the bare foot. That is, the invention provides footwear 160 which will move, expand and contract with the movement of the foot to provide comfort and stability. The layers of leather 166, foam 168 and rubber 170 provide cushioning for the wearer's foot.

Figure 12A:
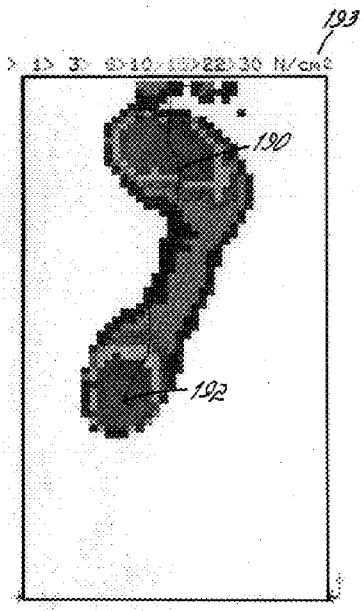
FIG. 12A is a color diagrammatic view of a pressure contour created by a bare foot walking dynamically across a pressure sensitive measuring surface.
Figure 12B:
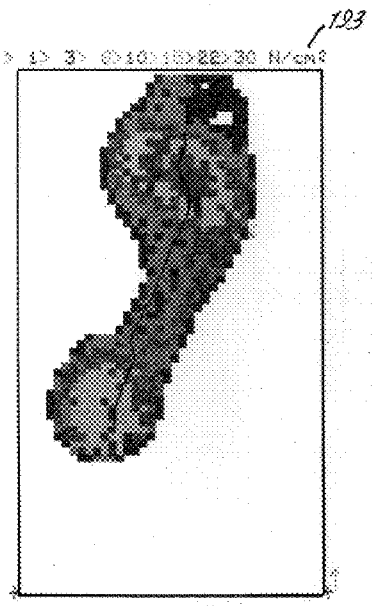
FIG. 12B is a color diagrammatic view of a foot wearing the footwear of the invention walking across a pressure sensitive measuring surface.
Figure 12C:
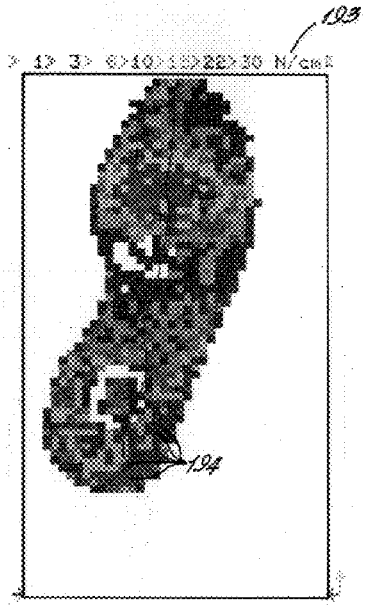
FIG. 12C is a color contour diagrammatic view of a foot wearing conventional footwear walking across a pressure sensitive measuring surface.

Referring to the color-coded FIGS. 12A, 12B and 12C, the effect of the footwear 160 of the invention is more clearly illustrated by pressure contours of a foot walking dynamically across a measuring surface. FIG. 12A illustrates a pressure contour associated with a single and unique bare human foot. The greatest downward force of the foot is experienced first in the heel region 192 and then in the ball region 190 as the stride is made. The reference bar 193 at the top of each figure illustrates the varying force per unit area ($N/cm^2$) as the colors vary. FIG. 12B illustrates a pressure contour the same human foot as in FIG. 12A for wearing footwear 160 constructed with the last of the invention. It is clearly seen that the pressure contour in the distribution of downward force very closely follows the pressure and force distribution of the bare foot and that the pressures have been reduced due to the improved shape of the footwear and the cushioning from the sole materials. The footwear 160 of the invention made with the inventive last 70 does not unnaturally bind or constrict the human foot nor unnaturally modify the distribution of forces associated with weight bearing and propulsion. FIGS. 12A and 12B further show that the level of pressure applied to the foot is reduced by wearing shoes of the present invention. Pressure of one type or another is the primary cause of most foot problems and pain.

FIG. 12C illustrates a pressure contour for the same foot as in FIG. 12A wearing a conventional shoe manufactured with a conventional last and having a traditional, flattened sole surface as is dictated by a conventional last. As may clearly be seen in FIG. 12C, the various pressures and forces acting in the foot during weight bearing and propulsion are distorted and shifted unnaturally with footwear manufactured on a conventional last. The unnatural shifting and distortion of downward foot pressure causes a reverse force or pressure into the foot which is unnatural and not expected by the body or bio-mechanically in harmony with the human foot or body. Foot discomfort, posture problems, and foot injuries all result from footwear manufactured on conventional lasts. Referring to FIG. 12C, the high pressures generally associated with the ball area 190 and heel area 192 are unnaturally spread over parts of the traditional shoe wearer's foot not meant to bear weight. Furthermore, pressures are unnaturally increased in certain areas of the foot. For example, pressure is unnaturally focused on the outside of the heel area as indicated by reference numeral 194. Additionally, the flat sole surface destroys the natural contour of the foot which contacts the ground surface while it unnaturally spreads out the various pressures and forces acting on the foot. Accordingly, the footwear manufactured on conventional lasts is not biomechanically in harmony with the bare human foot.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. Footwear for reducing the binding and unnatural pressures placed on a foot by conventional footwear comprising;

a compliant and generally hollow body for receiving a human foot including an upper and a sole attached to the upper, the sole having a contoured bottom surface with a toe region and a heel region and comprising:

an inner longitudinal arch formed on the sole surface and extending from the heel region to the toe region on an inner side of the sole surface;

an outer longitudinal arch formed on the sole surface and extending from the heel region to the toe region on an outer side of the sole surface;

a first transverse arch formed on the sole surface proximate the toe region of the sole surface;

a second transverse arch formed on the sole surface forward of the heel region;

the upper transitioning to the smooth sole surface in a continuous curve free from a sharply angled bottom featheredge;

said longitudinal and transverse arches collectively defining a horizontal cross-sectional area of the footwear body projected downwardly onto a horizontal ground plane, the inner longitudinal arch having a maximum vertical height above the ground plane;

a parting line defining a maximum cumulative horizontal cross-sectional area of the footwear body projected to the ground plane;

the footwear further characterized wherein:

the cumulative cross-sectional area projected downwardly onto said ground plane by said footwear body from a height above the ground plane of approximately 2.5% of the maximum arch height is approximately in the range of 10% to 20% of said maximum cumulative cross-sectional area; and the cumulative cross-sectional area projected downwardly onto said ground plane by said footwear body from a height above the ground plane of approximately 5% of the maximum arch height is approximately in the range of 20% to 35% of said maximum cumulative cross-sectional area;

the cumulative cross-sectional area projected downwardly onto said ground plane by said foot body from a height above the ground plane of approximately 10% of the maximum arch height is approximately in the range of 50% to 60% of said maximum comulative cross-sectional area;

whereby the footwear generally cooperates with the human foot and reduces binding and unnatural pressures to the foot when worn.

2. The footwear of claim 1 wherein the sole has a thickness dimension which is approximately equal over the surface of the sole such that a foot placed in the footwear during use is maintained, by the sole, spaced above a ground plane equal distances from the ground plane over generally the entire sole and the foot is supported as a bare foot with reduced distortion of the pressures experienced by the foot during weight bearing and propulsion.

3. The footwear of claim 2 wherein the sole comprises a plurality of layers, each sole layer having a thickness dimension which is approximately equal over the surface of the sole such that the cumulative sole layers maintain the foot spaced equal distances above the ground plane.

4. The footwear of claim 1 wherein the cumulative cross-sectional area projected downwardly onto said ground plane by said footwear from a height above the ground plane of approximately 7.5% of the maximum arch height is approximately in the range of 35% to 50% of said maximum cumulative cross-sectional area.

5. The footwear of claim 1 wherein the sole surface further comprises:

a group of three separate and discrete contact areas, the contact areas being discontinuous with respect to each other and intersecting a defined horizontal ground plane when the footwear is worn and the sole surface contacts the ground, the contact area group including:

a first contact area located in the toe region and proximate a forward end of the inner longitudinal arch on the inner side of the sole surface;

a second contact area located in the toe region and proximate a forward end of the outer longitudinal arch on the outer side of the sole surface; and a third contact area located proximate the heel region of the sole surface;

whereby the sole surface contacts the ground when the footwear is in use for proper expansion of the sole surface in cooperation with the expansion of the foot.

6. The footwear of claim 5 wherein the separate contact areas are oriented on the sole surface such that a line extending from the first contact area to the second contact area and a line extending from the first contact area to the third contact area form an angle approximately in the range of approximately 20° up to 120°.

7. The footwear last of claim 5 wherein the separate contact areas are oriented on the sole surface such that a line extending from the second contact area to the first contact area and a line extending from the second contact area to the third contact area form an angle in the range of approximately 160° down to 50°.

8. The footwear last of claim 5 wherein the contact areas are oriented on the sole surface such that a line extending from the third contact area to the first contact area and a line extending from the third contact area to the second contact area form an angle in the range of approximately 1° up to 45°.

9. The footwear of claim 5 wherein the cumulative cross-sectional area projected downwardly onto said ground plane by said three discrete contact areas at said ground plane is approximately in a range of 1% to 10% of said maximum cumulative cross-sectional area.

10. Footwear for reducing the binding and unnatural pressures placed on a foot by conventional footwear comprising:

a compliant and generally hollow body for receiving a human foot including an upper and a sole attached to the upper, the sole having a contoured bottom surface with a toe region and a heel region and comprising:

an inner longitudinal arch formed on the sole surface and extending from the heel region to the toe region on an inner side of the sole surface;

an outer longitudinal arch formed on the sole surface and extending from the heel region to the toe region on an outer side of the sole surface;

a first transverse arch formed on the sole surface proximate the toe region of the sole;

the upper transitioning to the sole surface in a continuous curve free from a sharply angled bottom featheredge;

a parting line extending around the footwear body and separating the upper and sole, the parting line including some outermost side points of the body in the upright position where planes tangential to said outermost points are generally perpendicular to a horizontal ground plane;

the parting line defining a maximum cumulative horizontal cross-sectional area of the footwear body projected downwardly onto said ground plane, and said inner longitudinal arch having a maximum vertical height above the ground plane defined by a point on said parting line;

the cumulative cross-sectional area projected downwardly onto said ground plane by said footwear body from a height above the ground plane of approximately 2.5% of the maximum arch height being approximately in the range of 10% to 20% of said maximum cumulative cross-sectional area;

the cumulative cross-sectional area projected downwardly onto said ground plane by said footwear body from a height above the ground plane of approximately 5% of the maximum arch height being approximately in the range of 20% to 35% of said maximum cumulative cross-sectional area;

the cumulative cross-sectional area projected downwardly onto said ground plane by said footwear body from a height above the ground plane of approximately 7.5% of the maximum arch height being approximately in the range of 35% to 50% of said maximum cumulative cross-sectional area;

the cumulative cross-sectional area projected downwardly onto said ground plane by said footwear from a height above the ground plane of approximately 10% of the maximum arch height being approximately in the range of 50% to 60% of said maximum cumulative cross-sectional area;

the cumulative cross-sectional area projected downwardly onto said ground plane by said footwear from a height above the base plane of approximately 20% of the maximum arch height being approximately in the range of 70% to 85% of said maximum cumulative cross-sectional area;

whereby the footwear generally cooperates with the human foot and reduces binding and unnatural pressures to the foot when worn.

11. The footwear of claim 10 further comprising a group of three discrete contact areas on the sole surface which intersect a defined horizontal ground plane when the footwear body is in a primary position on the ground plane, the contact areas including a first contact area located proximate a forward end of said inner longitudinal arch, a second contact area located proximate a forward end of said outer longitudinal arch and a third contact area proximate a rearward end of both said inner longitudinal arch and said outer longitudinal arch in the heel region of the sole.

12. The footwear of claim 11 where the contact areas are oriented on the sole surface such that a line extending from the first contact area to the second contact area and a line extending from the first contact area to the third contact area form an angle approximately in the range of 20° up to 120°.

13. The footwear of claim 11 where the contact areas are oriented on the sole surface such that a line extending from the second contact area to the first contact area and a line extending from the second contact area to the third contact area form an angle approximately in the range of 160° down to 50°.

14. The footwear of claim 11 where the contact areas are oriented on the sole surface such that a line extending from the third contact area to the first contact area and a line extending from the third contact area to the second contact area form an angle approximately in the range of 1° up to 45°.

15. The footwear of claim 11 wherein the cumulative cross-sectional area projected downwardly onto said ground plane by said three discrete contact areas at said ground plane is in a range of approximately 1% to 10% of said maximum cumulative cross-sectional area.

16. The footwear of claim 10 wherein the cumulative cross-sectional area projected downwardly onto said ground plane from a height above the ground plane of approximately 30% of the maximum arch height is approximately in the range of 85% to 90% of said maximum cumulative cross-sectional area.

17. The footwear of claim 10 wherein the cumulative cross-sectional area projected downwardly onto said ground plane by said last from a height above the ground plane of approximately 40% of the maximum arch height is approximately in the range of 90% to 93% of said maximum cumulative cross-sectional area.

18. The footwear of claim 10 further comprising a second transverse arch formed on the sole forward of the heel region.

* * * * *

UNITED STATES PATENT AND TRADEMARK OFFICE

CERTIFICATE OF CORRECTION

PATENT NO. : 6,014,824
DATED : January 18, 2000
INVENTOR(S) : Jerry F. Gumbert

It is certified that error appears in the above-identified patent and that said Letters Patent is hereby corrected as shown below:

Column 21,
Line 4, delete "point 13" and insert -- point 113"

Column 22,
Table 2, insert "." Three times, indicating three blank lines between the values of "0"and "2"

Column 30,
Line 15, (Claim 7, line 1), delete "footwear last" and insert -- footwear --.
Line 21, (Claim 8, line 1), delete "footwear last" and insert -- footwear --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*